US011361892B2

(12) United States Patent
Nellessen

(10) Patent No.: US 11,361,892 B2
(45) Date of Patent: Jun. 14, 2022

(54) MULTIPURPOSE PERMANENT MAGNETIC SYSTEM

(71) Applicant: John E. Nellessen, Anaheim, CA (US)

(72) Inventor: John E. Nellessen, Anaheim, CA (US)

( * ) Notice: Subject to any disclaimer, the term of this patent is extended or adjusted under 35 U.S.C. 154(b) by 0 days.

(21) Appl. No.: 16/792,314

(22) Filed: Feb. 17, 2020

(65) Prior Publication Data

US 2021/0257139 A1 Aug. 19, 2021

(51) Int. Cl.
*H01F 7/02* (2006.01)

(52) U.S. Cl.
CPC ..... *H01F 7/021* (2013.01)

(58) Field of Classification Search
CPC ..... H01F 7/021
See application file for complete search history.

(56) References Cited

U.S. PATENT DOCUMENTS 9,245,677 B2 * 1/2016 Fullerton ..... H01F 7/0273
2008/0074223 A1 * 3/2008 Pribonic ..... H01F 7/021 335/306
2009/0278642 A1 * 11/2009 Fullerton ..... H01F 7/0284 335/284
2017/0120401 A1 * 5/2017 Fullerton ..... B23P 15/001

FOREIGN PATENT DOCUMENTS

GB 2511574 A * 9/2014 ..... H02K 15/03

OTHER PUBLICATIONS ip.com search results.*

* cited by examiner

*Primary Examiner* — Mohamad A Musleh

(57) ABSTRACT

An versatile modular magnetic system, using multipolar magnets with poles aligned on the X, Y and Z axis for holding pieces in alignment, expandable on the X, Y, and Z axis with pieces sandwiched between magnets, magnetic on two faces, magnetically and mechanically holds to surfaces, magnetically and mechanically holds to itself, opens and closes, magnet gaps adjusted to optimize magnet material.

22 Claims, 41 Drawing Sheets

Fig, 2B
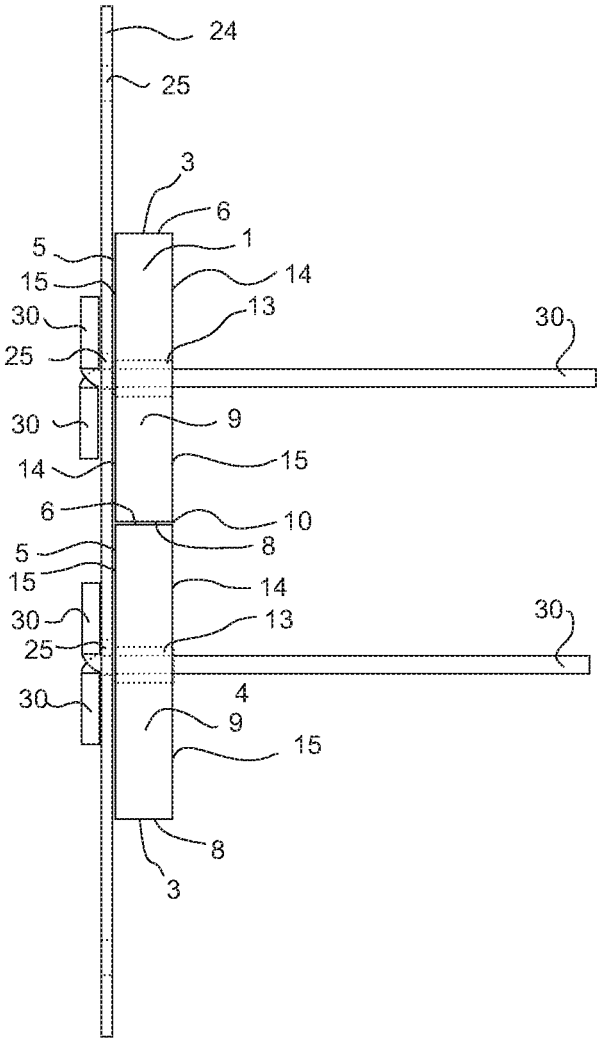

FIG. 4F Flexible Magnet

MULTIPURPOSE PERMANENT MAGNETIC SYSTEM

BACKGROUND

Field of Invention

The present invention relates to permanent magnetic systems (PMSs) used as attracters, aligners, organizers, holders, hangers, sweepers, pickups and finders, to other magnets, to elongated ferromagnetic pieces (FMPs) and to non-magnetic pieces (NMPs) while simultaneously magnetic on two flat faces.

Description of Prior Art

Permanent magnetic systems (PMS) are generally used as holders, aligners, hangers, sweepers, pickups, finders, organizers and other purposes to work with FMPs. Metal machinists, repair people, auto mechanics, construction workers, fisherman, Point of product display makers, FMP manufacturers and others using FMPs use these type of PMS. PMS make working with (FMPs) easier in many ways. Some FMPs are hard to find because they are hidden behind nonmagnetic surfaces; like nails behind drywall. Some FMP are hard to retrieve because they are under water or in a dark hard to reach crack. Some are hard to hold because they have no handle and are sharp and very small like needles. Some have elongated bodies and when picked up they do not lay parallel like nails or drill bits. Some have one end that is use for a tool and the other end to drive fasteners like a screwdriver bit or a nut driver bit. Some are only ferromagnetic on one end like a hammer or hand screwdriver. Some are on the floor and we need to clean them up like box a spill bolts. Some we want to be in size order like drill bits or sockets.

Various FMP holders and the like have been proposed to address these problems. For example, Olsen, U.S. Pat. No. 4,508,221, discloses a FMP, magnets with gaps in between, for holding a variety of small tools such as drill bits, saw blades, or the like for a power tool. The holder is configured to be adhesively attached directly to a power tool. Olsen discloses a cover sheet with tool-receiving pockets and an elastic strap or band to retain tool bits, and a chuck key.

Balzano, Similarly, U.S. Pat. No. 5,506,661, discloses a FMP, magnets with gaps in between, holder that attaches directly to the hand tool, and uses a hook and loop fastener, and may optionally include a belt loop attachment.

Stern, U.S. Pat. No. 6,910,578, discloses a portable hand power tool accessory holder, base strip for attachment to the hand tool, and an elastic band carried by the base strip forming a plurality of sleeves for retaining tool bits. A restraining magnet is included for engaging the bits, and a utility magnet is carried in the elastic band to magnetically engaging the bits for temporary storage.

Ahern, U.S. Pat. No. 5,460,305, discloses a large panel that includes a number of tool pouches. The perimeter of the large panel is provided with a beveled edge comprising a 60 series of magnets with gaps in between or a magnetic strip for attaching the panel to the side of an automobile. The large panel includes a plurality of pouches into which tools may be inserted during use. Ahern does not disclose or contemplate or provide any mechanism for retaining tool bits or hardware parts, or any closeable means for storage of parts and bits.

Bosch, U.S. Pat. No. 4,826,059, discloses a portable magnetic tool holder with a rear face that includes a plurality of magnetic bars, with gaps in between, positioned vertically and side by side across an upper portion of the flexible main body of the tool holder. The tool holder includes pockets, loops, and straps for retaining tools.

4826059 Bosch has these things in common with my invention:

1) holds on two faces
2) slightly flexible to hold to slightly curved FMS
3) closes magnetically
4) flexible hinge added of material or velcro,
5) is magnetically closing
6) holds non magnetic pieces with additional pockets apron loops 826059 Bosch has these things different from my invention:

1) claims holding means, specifies loops . . . does not specify hold means as holes for alignment with pegboard system,
2) upper and lower apron and pockets and insulative material makes for excessive material to cover FMP . . . mine uses magnet as cover
3) upper and lower apron and pockets and insulative material makes for excessive material decreasing holding force on FMS or when closing due to distance made by excessive material
4) magnets have gaps, mine are two or more poles each face optimized for FMS holding
5) magnets are not alternating poles and will cause FMP to lay in non-aligned directions, mine has alternating pole and will cause the FMP to pay in parallel alignment to FMS
6) uses Velcro mine has no loops or Velcro excess material needed . . . mine is less parts with a hole applied to post mechanically or to a FMS magnetically or to another magnet magnetically
7) Does not connect on the periphery, not stacking on periphery to build an array due to excess material on all sides . . . mine is a modular system to allow the user to adjust size for their application stacking on the periphery in symmetrical columns and or rows also stacking face to face also stacking on the periphery a pegboard system also stacking on face to face on a pegboard system also stacking on a non magnetic surface on the periphery also stacking face to face on a non-magnetic surface Devine, U.S. Pat. No. 6,587,022, discloses a foldable portable magnetic tool mat. Elongate bar magnets, with gaps in between, are disposed in holding portions defined in the tool mat. A strap system is provided to attach the mat, for example, to a ladder surface. Wherein tools may be releasably retained by merely placing them on the tool mat.

Pedrin, U.S. Pat. No. 10,207,401 relates to a magnetic tool bit wallet with a lot of loops, pockets and non-magnetic holders specifically for tool bits and separate type magnet added for a closure flap and separate type magnet added for holding to a FMS magnets with gaps in between and separate type magnet for holding bits.

Erlandsson, U.S. Pat. No. 8,981,887, relates to a magnetic tool holder used to hold tools on one face while holding the device on a ferromagnetic surface, comprising two different size magnets with gaps in between.

Prior art two faced PMSs remain deficient in the following ways; followed by the remedy that my invention provides:

1) Prior art focuses on tools as opposed to other FMPs and FMSs. Many FMPs are thin, elongated and flat and most all FMS are thin, elongated and flat. Prior art is made with gaps between magnets designed to hold thick, contoured tools. Prior art does not consider and specify the magnet gaps best used to align and hold thin, elongated and flat FMPs or FMSs. Therefore they are only efficient at holding thick curved or contoured tools in systems that comprise gaps between magnets for deeper magnetic fields. This is inefficient use of magnet material for the strength provided to hold thin, elongated and/or flat FMPs and FMSs.

a. These are remedied by my invention designed to hold to FMS which are flat while working with multiple FMP types including machined ferrous parts in process, parts to be welded, parts the be glued, parts to be painted, blades, needles, drill bits, sockets, nails, screws, fasteners, thick tools, contoured tools, curved tools, pipes, rebar, scrap steel, 2) Single purpose FMP holders are remedied by a multipurpose PMS:

a. Attracting FMP together in an organized parallel fashion, b. picking up FMP in parallel alignment from a surface like a table or floor, c. finding the center of FMP hidden behind non-ferromagnetic surfaces aligned with the center of a multi pole magnet d. holding for storage and portability FMP in parallel alignment 3) Gap(s) is(are) made between each magnet and magnets are alternated to achieve alternating poles. Magnets with gaps require more magnetic material to achieve the same holding force on a flat thin surface.

a. Remedied by using no gap on magnets to hold FMS and defined gaps between magnets to hold FMP, minimizing the amount of magnet material needed to hold both FMS and FMP at the same time. The polar gap should be zero for the magnet holding on the FMS. The gap on the second magnet should be about one half of the thickness of the FMP being held or larger if the FMP is contoured. The goal is to use the minimum amount of magnet material to gain the maximum holding force for the application. Larger gaps are defined for FMPs which are thicker than the FMS on the opposite side, narrower than the magnet, contoured so that full contact is not made with the magnet surface or odd curving shapes.

No gaps is defined as optimum for FMPs which are thin flat and cover the surface of the magnet. In which case a second magnet is not needed.

4) Holds to FMS while holding FMP in directions diagonal to the system a. Remedied by a FMS which holds to Ferromagnetic Surfaces (FMS) while attracting, picking up, and holding FMP aligned parallel to poles in columns and rows 5) Single pole magnets having an undefined gap between them, arranged affixed to a substrate having alternating poles. This pole arrangement does not have the strongest hold on FMS due to the length of the return path and the flux leakage through the thin FMS a. Remedied by considering the thickness of the FMS and calculating the number of poles that is optimum on each magnet face. At least two poles increases holding strength on contact with FMS.

6) Single pole magnets having an undefined gap between them, arranged affixed to a substrate having alternating poles. This pole arrangement does not have the strongest hold on FMP due to the length of the return path and the flux leakage through the thin FMP.

a. Remedied by considering the thickness and contour of the FMP and calculating the number of poles that is optimum on each magnet face. Considering the thickness and contour of the FMP and adjusting the gap between magnets larger for thicker and more contoured FMPs.

7) Single pole magnets having an undefined gap between them, arranged affixed to a substrate having alternating poles suffer holding strength losses. The thin FMS is the return path for the magnetic circuit. When the FMP is attracted to the side opposite the FMS it is weakly held due flux loses caused by the long length of the FMS return path, a. Remedied by completing the magnetic circuit by the shortest return path. Completing the shortest return path by making at least two poles on each magnet face with no gaps. Strength is gained on the side holding the FMP due to the shortest possible circuit through the FMS return path on the opposite side.

8) Magnets with at least two poles on each face are not used in this type of system.

a. Remedied by my invention of a magnet with more than one pole on each face and if needed a gap between a second magnet. To maximize the holding strength on a flat thin FMS, ideally the magnet should be one magnet with multiple poles; each pole width and thickness being about twice the thickness the FMS. However, to hold the FMP a magnet with different pole spacing is optimum. Single pole magnets having a gap between them, arranged affixed to a substrate having alternating poles can work for the side holding FMP if the gap is optimally defined.

9) When the polar gaps are not defined there are losses in magnetic holding strength and wasted magnet material. Just as the FMS is the return path for the FMP, the FMP is the return path for the FMS. They form a symbiotic magnetic circuit. The gaps used to hold the FMP are not defined for optimal use. Therefore there are magnetic flux losses on the FMP side, These losses cause the holding force on the FMS side to be weaker than is could be if the FMP side gaps were optimal.

a. Remedied by defining the magnetic gaps on the FMP side to the optimal. Forming the gap(s) on FMP side with the shortest return path while at the same time having the maximum amount of flux from the magnets flowing through the FMP return path in turn increases the holding force on the FMS side of the magnet(s).

10) Does not open and close magnetically; it uses an added part of a zipper or hook and loop fastener.

a. Remedied by designing the same magnet that holds the FMP and the FMS also closes magnetically with other magnets of same polar alignment. No zipper, button, hook and loop fasteners, latches or external magnet closures are necessary.

11) When system is stacked, closed or folded on itself, single pole magnets having a gap between them, having alternating poles, due to the length of the return path, lose the strength a. Remedied by designing the more than two poles per face of the magnet causes the shortest return path and therefore stronger stacking, stronger closing and folding upon itself. Greater holding forces are offered for the same amount of magnet material when the gap is defined optimally.

12) Magnets can be stacked closed or folded on themselves with FMPs in between, but when the FMPs does not align parallel to the north and south poles of each magnet then magnetism is lost due to misalignment or FMP conducting magnetism away from the strongest point in the center of the magnet(s) to around the lip of the magnet(s)
   a. Remedied by designing magnets that are stacked or folded on other same magnets to aligned FMPs parallel to each other and between each additional magnet at the point of optimum magnetic strength on the dividing line between north and south poles completing the magnetic circuit in the optimum flux path.
13) Some tool holder magnets do not align to stack and therefore protect FMPs from external impact damage, the elements and damage from each other.
   a. Remedied by designing magnets that are stacked or folded on other same magnets to aligned FMPs parallel to each other and between each additional magnet at the point of optimum magnetic strength where they are protected from external impact damage, the elements and damage from each other.
14) Magnet poles do not align parallel to help with organization, visual finding and handling in groups of parallel pieces,
   a. Remedied by designing magnets that aligned FMPs parallel to each other to help with organization, visual finding on center behind a non-magnetic surface, handling in groups of parallel pieces,
15) Magnet poles do not align parallel on two perpendicular axis
   a. Remedied by designing magnets that aligned poles arranged in rectangular shape it offer parallel alignment of FMP in two axis, rows and columns to form a grid which can be labeled on the rows and columns for easy keeping and finding of parts without labeling each part.
16) Some designs use two size magnets creating more production and warehousing costs and assembly time.
   a. My invention uses one size magnet throughout the system saving costs on production, warehousing and assembly time. The magnets size and shape are designed to be a self attracting self aligning modular tile to cover a larger area system if desired.
17) Some designs claim gaps between rounds magnets which wastes magnetic material to achieve the same holding force on FMS.
   a. My invention eliminates gaps between round magnets by using rectangular magnets wherein magnets make contact on the periphery and all alternating poles align to attract in a rectangular pole pattern with no gaps as desired for FMSs of thin material and for flat thin FMPs.
18) One PMS design boasts up to 80% coverage of PMS surface with magnets.
   a. My invention eliminates gaps and covers up to 99% of the PMS surface with magnets. When hanging on a pegboard wall with adjacent edges attracted touching my invention covers 99% of the FMS surface. Only the hole is not magnet. When larger gaps are needed for thicker or more contoured surfaces my invention employs flexible connectors in the gap(s) and covers as little as 80% of the PMS surface. When desired for holding separate FMPs on separate magnets my invention can employ magnets which cover 100% of the FMP surface. The magnets are then connected by at least one flexible connector of any size to form column(s) and row(s). The flexible connector can then have at least two holes for hanging support of magnetic poles in columns and rows.
19) Magnetic pole alignment in some systems create a diagonal to the system pattern which does not allow for folding upon itself to create a rectangular book like closure on the FMP, which can be easily stored in a rectangular drawer, tool box, or peg board rectangular grid system,
   a. My invention's pole alignment is rectangular to the system to facilitate folding upon itself and creating a rectangular book like closure on the FMP holding them firmly, in alignment which can be easily stored efficiently in or on a ferromagnetic or non-ferromagnetic rectangular appliance, file cabinet, drawer, table, shelf, tool box, or peg board rectangular grid system.
20) Magnetic pole alignment in some prior art does not lend itself to efficiently stacking in alignment with the edge of the PMS and holes of the PMS. Prior art polarity alignment of two different size magnets does not allow magnetic stacking of like pole sizes. A large North must be attracting a small south and vice versa when the system is folded on itself in a non symmetrical way.
   a. My invention's pole alignment is rectangular to the system, of the same size magnets, in polar alignment with the PMS edges and holes to facilitate folding upon itself and creating symmetrical book like closure on the FMP holding them firmly, in alignment and protected from damage.
21) Magnet position of two different size round magnets nested with gaps near each other does not allow folding of the PMS upon itself. The magnets hit each other and reduce flexibility to the PMS when be placed on a curved surface or folded.
   a. My invention's magnet position in column(s) and row(s) to form a rectangular FMS and to facilitate folding upon itself on two axis creating a book like closure or curving to attract flush to a curved FMS.
22) Some designs do not allow folding magnet upon magnet without excess flap, loops and slots in the material. More than the minimal amount of material for the flexible connector to hinge the magnets closed is used. This takes up as much as twice as much space for the FMS storage footprint when placed a pegboard wall, on the shelf, pocket, in a box, drawer, tool box, etc.
   a. My invention magnet pole alignment is in row(s) and column(s) aligned to the FMS to facilitate folding upon itself by creating a hinging gap, creating a book like closure on the FMPs holding them firmly, in alignment, protected from damage and creating maximum flexibility of the system on two axis, taking up ½ or less of the storage footprint.
23) One design does not allow FMP to hang over the edges of the system in row or column alignment with the rectangular system edges. Due to the diagonal pole pattern FMPs are held to extend diagonally off the system; creating a bigger storage footprint and a non-rectangular storage footprint.
   a. My invention's magnet assembly and polar alignment are rectangular and align to a rectangular system to facilitate folding upon itself and creating a book like closure on the FMPs holding them firmly, in alignment, protected from damage and creating maximum flexibility of the system on two axis, taking up ½ of less of the storage footprint, in the event that the FMPs extend beyond the system they will be in parallel alignment with the system edges creating a smaller rectangular storage footprint.

24) Many prior art designs do not have a mechanical means to hang.
   a. Remedied by my invention's mechanical means to hang. Through hole(s) in the magnet allows stacking several magnets on a peg or in an array of pegs sided to side or hanging with flexible connectors or folded on themselves with flexible connectors or hanging by hole(s) in the flexible connectors. The same magnet is used with holes in the same place therefore the holes are in symmetrical alignment to match up when the system is folded upon itself. The magnet poles alignment are in rectangular alignment to each other and the system to facilitate hanging in a rectangular alignment to the pegboard holes or the rectangular FMS.

25) Many prior art designs use many individual magnets with no magnets having more than one pole on each face.
   a. My invention uses one magnet with multiple poles to replace individual magnets. Therefore my invention decreases the number of part used and save installation time assembly time and materials for assembling multiple magnets. It also makes it easier for less skilled workers to assemble without testing polarity during the manufacturing process.

26) Prior art uses excess materials to keep magnets from moving. Often times sandwiching the magnets between layers of non-magnetic material.
   a. My invention preferred embodiment is to be used without non-magnetic flexible material to keep magnets in position. It simply uses the magnetic attraction on the periphery, the hole in the magnet and or the FMS for keeping the magnets in position. Protective layers may be added in an alternative embodiment but decrease the effective magnetic strength.

27) Prior art uses multiple pieces wasting materials and assembly time.
   a. My invention allows for making one piece of flexible magnetic material to form the whole system. FIG. 19 et al

SUMMARY

In accordance with the present invention a permanent magnetic system comprising at least two permanent magnets and a gap connector which attracts, aligns, organizes, holds, hangs, sweeps, picks up and finds ferromagnetic pieces, while also holding said magnets to a ferromagnetic surface, while also holding and aligning said magnets with each other, while also for holding said magnets mechanically to a post, while also holding and organizing non magnetic pieces.

Objects and Advantages

Accordingly, besides the objects and advantages of the magnetic holders described in my above patent, several objects and advantages of the present permanent magnetic system are:

1) to provide the shortest return path possible in one magnet for optimum holding an a flat thin FMS. The magnet of my invention is made with alternating poles therefore the poles are as close together as possible forming the shortest possible magnetic circuit for maximum flat thin FMS holding strength, as opposed to depth of pull created by a pole gap;
2) to find the center of FMP magnetically;
3) to pick up FMP magnetically;
4) to align FMP magnetically parallel to alternating poles on the system face;
5) to holds FMP magnetically;
6) to transports from storage to work area and back while magnetically holding in a safe secure system;
7) to visually display FMP magnetically in rows, columns or a grid for easy to find parts;
8) to label FMP locations by magnetically locating them in rows, columns and stacks therefore naming there locations by X, Y and Z coordinates;
9) to hold magnetically on two sides to FMP or FMS or other magnets of the same polar alignment;
10) to join magnets magnetically side to side, in two pole polar alignment, to form X axis rows and Y axis columns;
11) to join magnets magnetically face to face, in two pole polar alignment on the Z axis to form stacks;
12) to hold two magnets magnetically wherein said first magnet is attracted to said second magnet by peripheries and the faces of each magnet are held magnetically to a FMS;
13) to hold two magnets magnetically wherein said first magnet first face is attracted to said second magnet second face while also said second magnet first face is held magnetically to a FMS;
14) to hold two magnets magnetically wherein said first magnet first face is attracted to said second magnet second face while also both magnets are held weakly magnetically on the sides to a FMS;
15) to stack face to face with other magnets of the same two or more pole, polar alignment preventing rotation or slippage on the faces;
16) to align face to face with other magnets of the of the same two or more pole, polar alignment automatically as the two magnets draw near to each other;
17) to stack face to face with other magnets of the of the same two or more pole, polar alignment with FMPs in between magnets holding FMPs stronger magnetically as part of the magnetic circuit while also forming a mechanical cover;
18) to pick up parts spilled on the counter or floor in alignment with poles in columns and rows on the magnets
19) to conduct the shortest possible magnetic circuit using the FMS and the FMP as complimentary return paths;
20) to stack FMP and FMS on the first face increases the holding strength of FMPs and FMSs on the second face by creating the shortest possible complimentary magnetic circuit;
21) to increase the magnet to magnet magnetic attraction when two such magnets are stacked face to face by placing FMPs and FMSs on the outside;
22) to hold thin non-magnetic pieces between FMSs or other magnets of the same polar alignment;
23) to hold FMPs with sharp points and edges in place, covered by flexible non magnetic gap connector(s) to hide the FMPs from damaging external things such as the user's body, user's pockets, back packs, carrying bags, while also protecting the FMPs from external things that may inflicting damage on the FMPs by impact while also protecting FMPs from damaging other FMPs in transit;

24) to stack FMPs between two of these magnets face to face protects FMPs on both sides. Holds FMPs with sharp points and edges in place to protect user's body, user's pockets, FMPs from external impact damage, FMPs from damaging other parts while in storage;

25) to join face to face mechanically with posts hooks through the through holes;

26) to join side to side, mechanically with posts hooks through the through holes;

27) to join magnetically while also mechanically, face to face while also side to side to build on the X Y and Z axis directions While also increasing the alignment and holding strength of FMPs magnetically and mechanically by pinching. While also increasing the alignment and holding strength of each magnet to another magnet by the magnetic poles arranged to form aligned X Y and Z holding directions;

28) to assist some FMPs which already have a means of hanging partly or fully mechanically on a post hook, in this case the magnet can be used to even more securely hold, align and protect these type FMPs;

29) to facilitate transporting the magnetic system a bolt and nut or closing ring or cable or string may be disposed through the through hole of one or many magnets to facilitate alignment, securing the system, transportation from storage to work area, lowering and raising on a stick, mounting to other surfaces with fasteners and all the normal uses for holes to facilitate transportation;

30) to provide a means to hold in alignment non-magnetic pieces (NMP) mechanically affixed to the magnet via the magnet through hole; to allow non-magnetic parts to be held magnetically to FMS or other FMP or other magnet;

31) to provide a means to affix on a vertical wall or affix on a horizontal surface more than one magnet magnetically from a first magnet which is being held mechanically buy the first magnet hole and at least one second magnet is held magnetically to said first magnet face to face on the Z axis or side to side on the X or Y axis or any combination of the three axis;

32) to provide a magnetic system wherein magnets may be affixed mechanically by their through hole to a vertical, horizontal or up side down surface and at least one second magnet is held magnetically to said first magnet face to face on the Z axis or side to side on the X or Y axis or any combination of the three axis;

33) to provide a secondary means of holding the system mechanically to a post, wherein said first magnet is attracted and aligned to said second magnet face to face, with at least one ferromagnetic piece between the two magnets, forming a through hole, wherein said through hole is slid over a post;

34) to provide a permanent magnet system that is versatile to hold many thickness, curves and contours of FMP with the least amount of magnet material by multipolar magnets for holding on thin flat FMS and while also providing an adjustable gap between the multipolar magnets to accommodate thick, curved or contoured FMPs. After the FMPs to be applied is determined by the customer then the inventor must analyze the type material, dimensions, shape, curves and contours to determined the gap between multipolar magnets. If the gap is determined greater than zero then my system provides an adjustable gap from only a crack to the desired optimum. Once the gap is determined greater than zero my system provides a mechanical means to keep that gap. The preferred mechanical means is adhesive sheet or tape of the flexible, non-magnetic type (i.e. vinyl, leather, pleather, duct, PVC, PE, PU, cloth, etc.). Alternatively, sewing or ultrasonic welding or molding of a non-magnetic, flexible material can be used to set the gaps between magnets;

35) to provide a flexible non-magnetic gap connector material (FNGCM) that will facilitate folding the magnets face to face while also being rigid enough to keep the gap parallel to the magnet edges and of the size gap desired. The gap material will not stretch much, this prevents the gap from changing size;

36) to provide a system with flexible non-magnetic gap connector material to maintain alternating magnetic poles in (a) column(s) and (a) row(s) the gap is consistent down a column or across a row(s) to provide parallel alignment:

37) to provide excess flexible non-magnetic gap connector material (FNGCM) when needed which facilitates hanging by mechanical means other than a hole through the magnet by offering holes through in the connector material;

38) to provide adjustable flexible non-magnetic gap connector material (FNGCM) to increase the gap when needed for the capacity of holding and protecting FMPs and NMPs when folded closed face to face.

39) to provide system with a means of hanging mechanically wherein said first magnet hole is slid over one post hook while connector mechanically holds second magnet vertically below first magnet no second post hook is needed;

40) to provide system with a means of hanging mechanically wherein first connector material from first face to face holds the gap on the first face while a second connector material from second face to face holds the gap on the second face while the first connector material and second connector material in the gap are affixed to each other to hold the gap distance more strongly;

41) to provide system with a means of hanging mechanically wherein said first magnet is folded face to face closed over said second magnet forming a loop with said connector wherein said connector loop is slid over a post or hook 42) to provide system with a means of hanging mechanically wherein magnets do not have through holes instead the two connector materials have an excess tab of material with through holes in alignment when magnets are closed face to face or open, wherein said connector holes are slid over at least one post.

DRAWING FIGURES

In the drawings, closely related figures have the same number but different alphabetic suffixes.

FIG. 2B shows a side view of the preferred embodiment in one operational position on a peg board.

FIG. 4E-4H shows a side view of an embodiment in one operational position on a peg board.

Figure 14A:
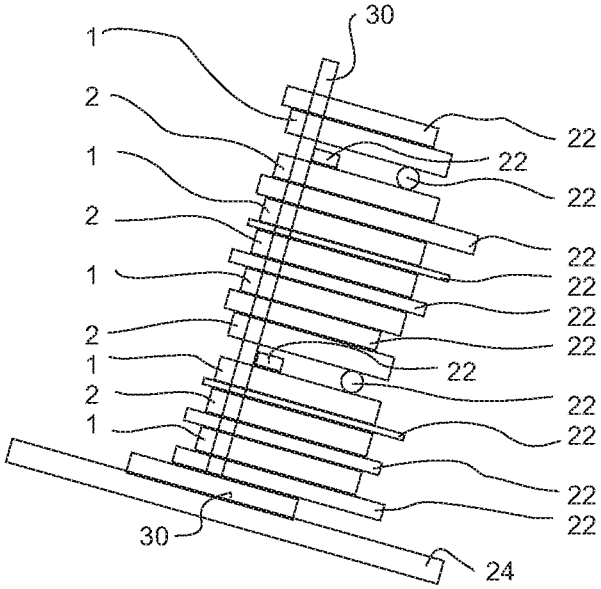
Figure 14B:
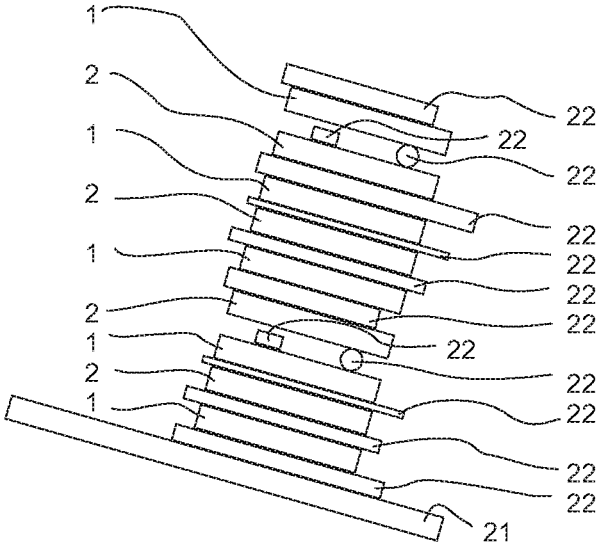

FIG. 14A shows a side view of a preferred embodiment of the system in the closed position, with no mechanical gap connectors, only magnetic gap connectors and magnetic face to face attraction, while mechanically joined on a peg board post hook, face to face, holding FMPs FIG. 14B shows a side view of a preferred embodiment of the system in the closed position, with no mechanical gap connectors, only magnetic gap connectors and magnetic face to face attraction, while magnetically joined, face to face, holding FMPs.

Figure 15A:
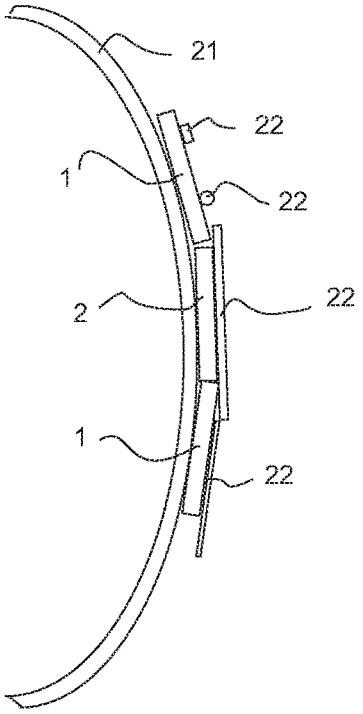

FIG. 15A shows a side view of an embodiment of the system with nine magnets in a grid array 3 magnets×3 magnets, forming columns and rows of alternating magnetic poles attracting edge to edge while attracting on the first faces to a curved thick FMS, with a crack gap magnetic connector, with flexible non magnetic gap connectors, while holding FMPs. In this case the gap should be larger to be optimized due to the thickness of the FMS.

Figure 15B:
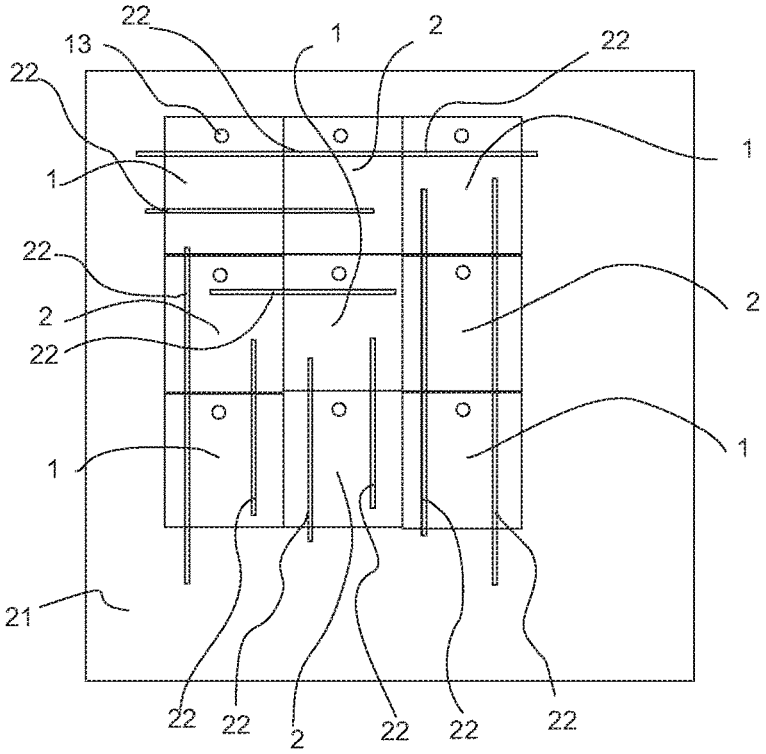

FIG. 15B shows the side view of 15A

Figure 15C:
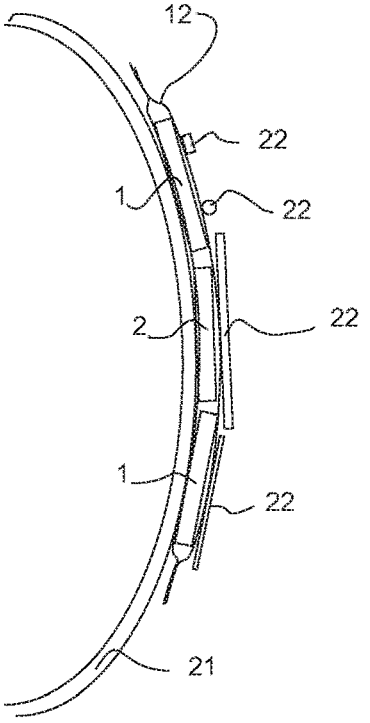

FIG. 15C shows a side view of a preferred embodiment of the system with nine magnets in a grid array 3 magnets×3 magnets, forming columns and rows of alternating magnetic poles attracting edge to edge while attracting on the first faces to a curved thick FMS, with a flexible non magnetic gap connectors, while holding FMPs. In this case the larger gaps cause the system to hold stronger to the thick FMS with the same amount of magnet material used as 15A.

Figure 15D:
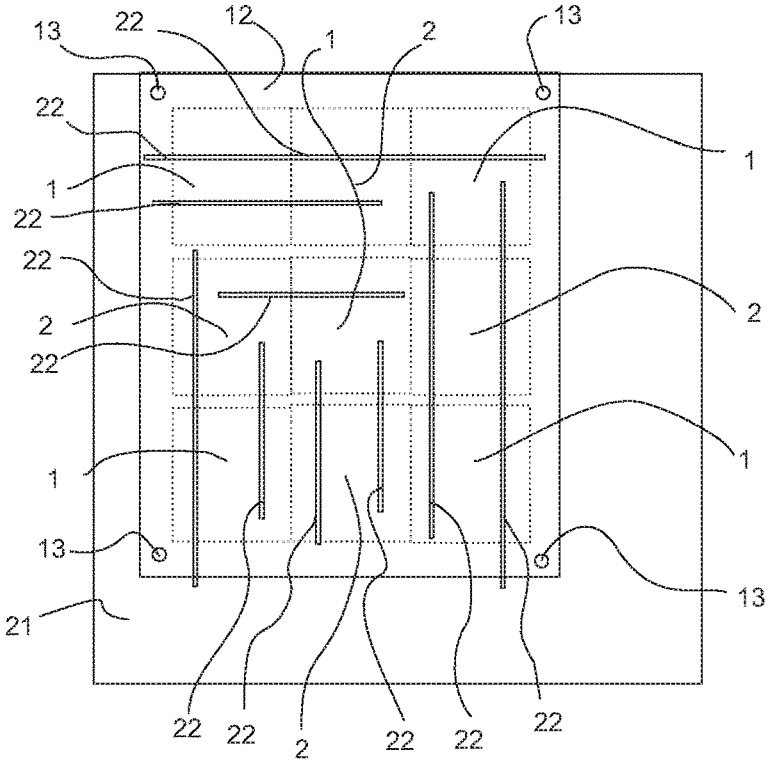

FIG. 15D shows the side view of 15C.

Figure 16:
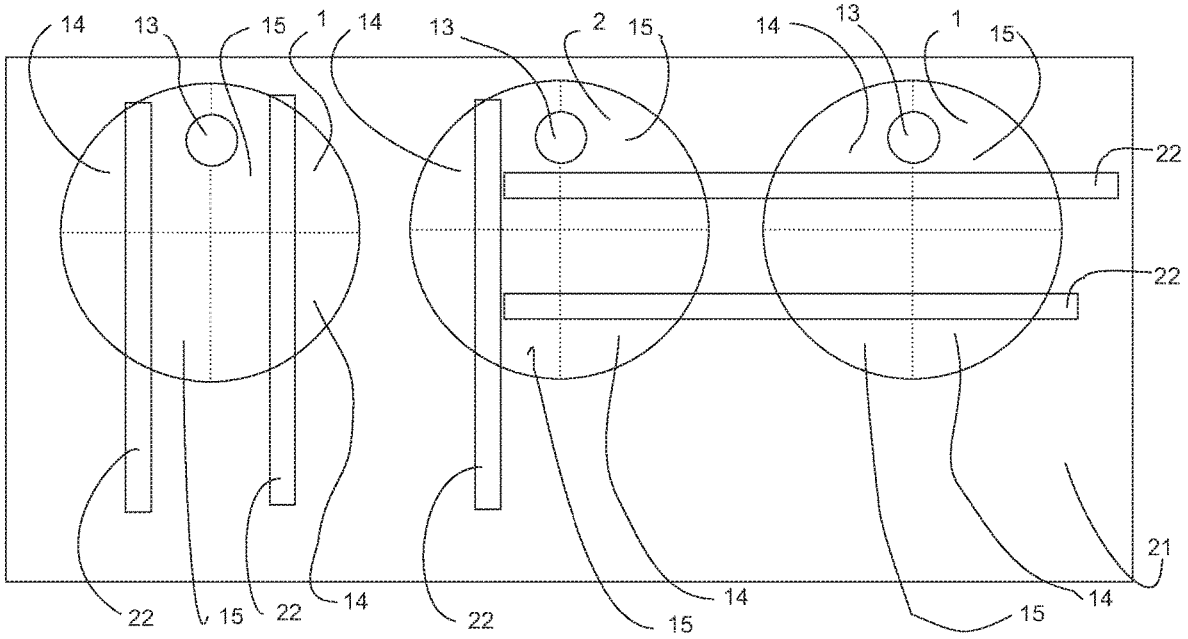

FIG. 16 shows a face view of an alternate embodiment where the magnets are round but the alignment of the faces still create the alternating magnetic poles in rows and columns and the adjustable gap between magnets for elongated FMPs.

Figure 17:
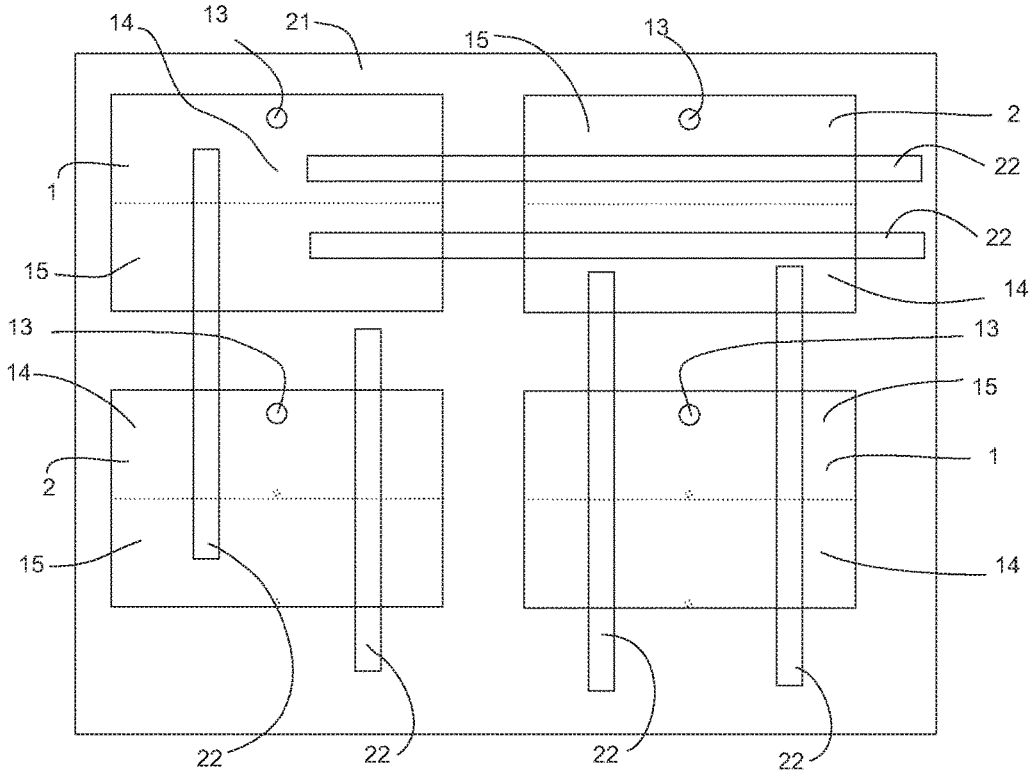

FIG. 17 shows a face view of a preferred embodiment with large gaps to accommodate very elongated FMPs.

Figure 18A:
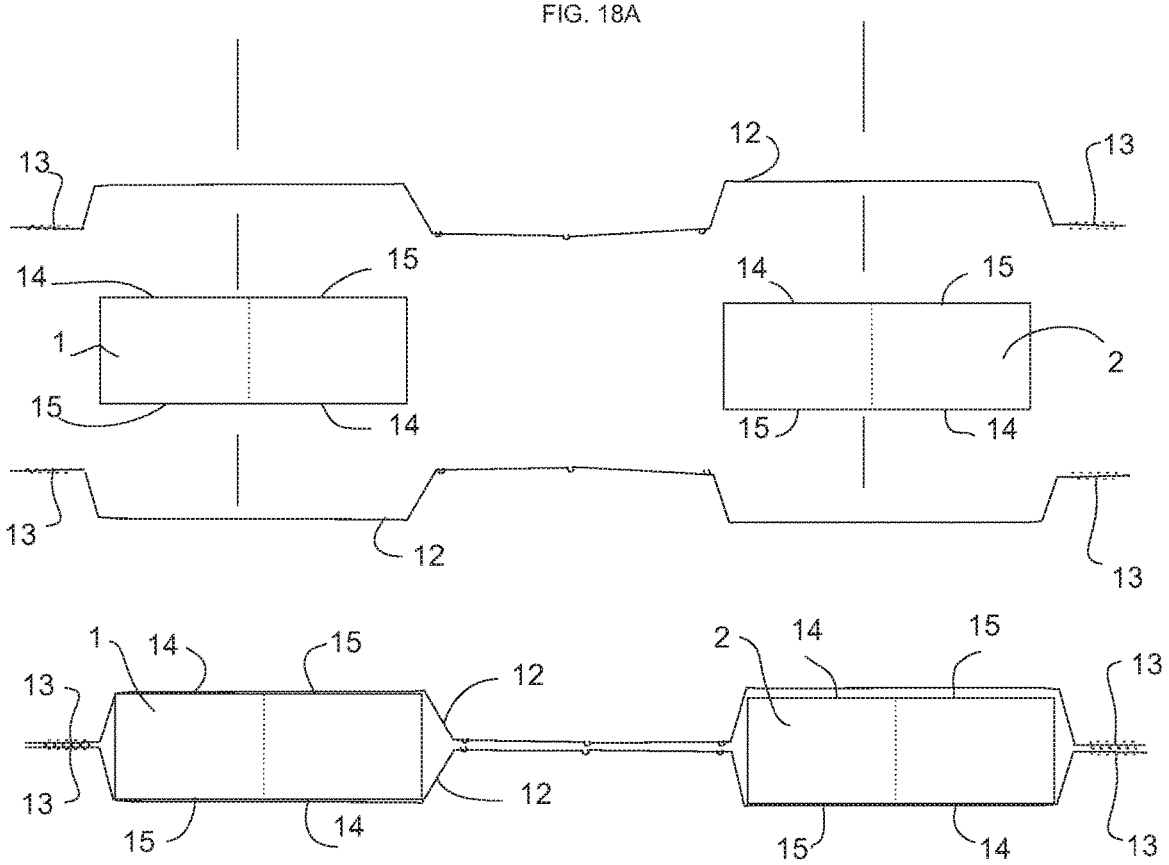

FIG. 18A shows a side expanded view of a preferred embodiment using four magnets each having two poles on each face sandwiched between two non magnetic flexible gap materials which are over sized to allow the holes to be in them instead of the magnets.

Figure 18B:
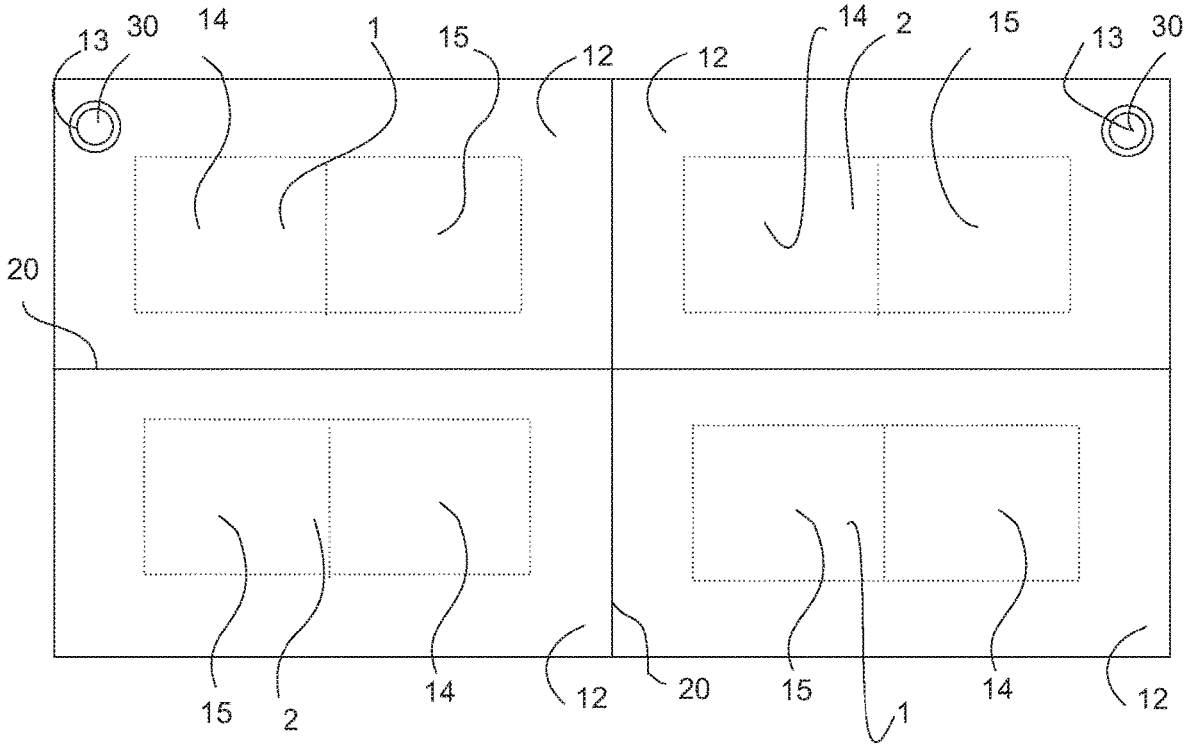

FIG. 18B shows a face view of 18A.

Figure 19A:
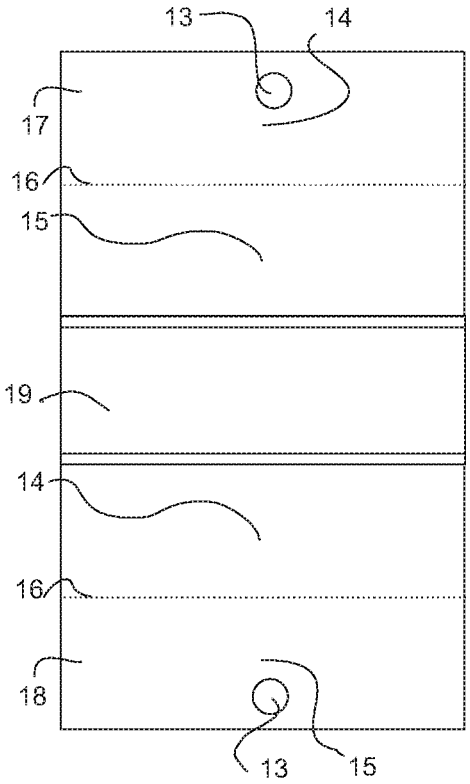

FIG. 19A shows a face view of an alternate embodiment of one solid flexible magnet mold to have two poles on one face then a gap then two poles on one face and a connector made of flexible magnet material, the holes are in the magnet material.

Figure 19B:
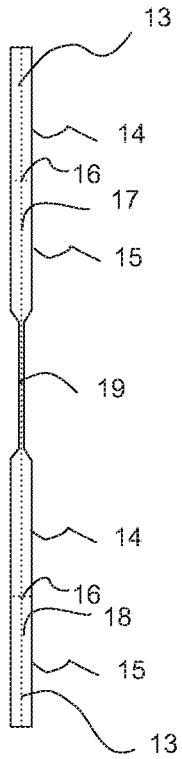

FIG. 19B shows a side view of 19A

Figure 20:
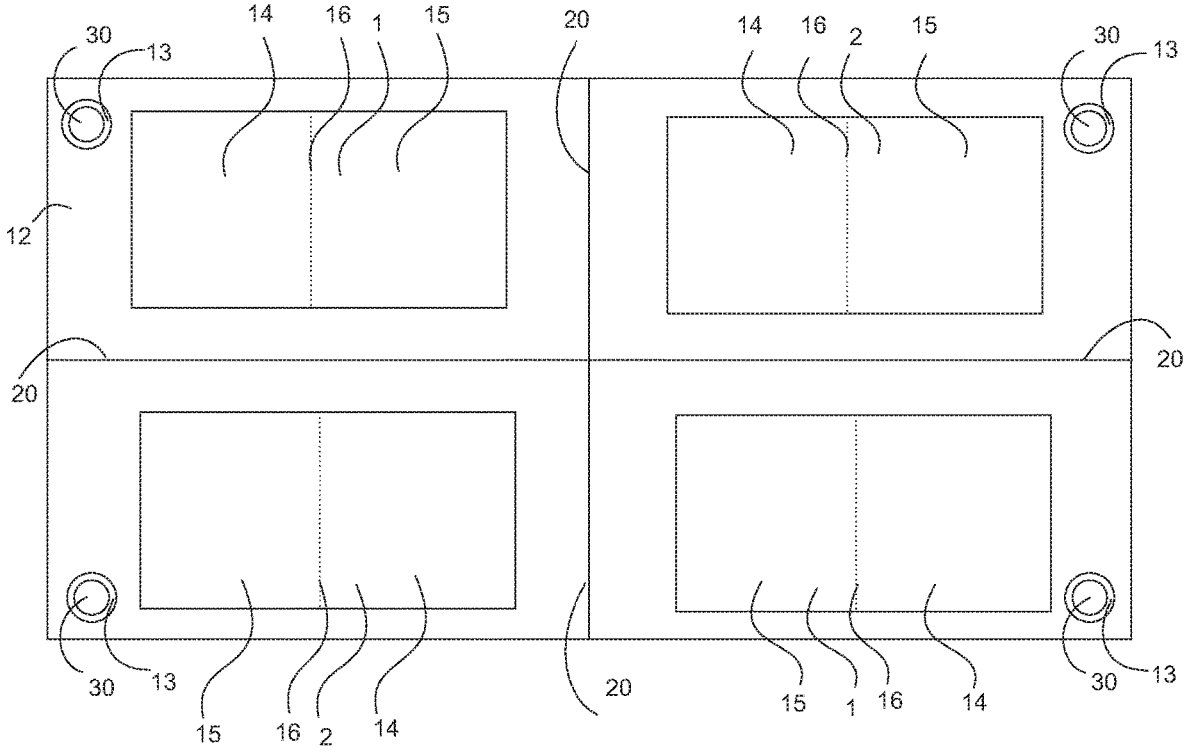

FIG. 20 shows a face view of the same as 18B except using four poles on each magnet face.

Figure 21:
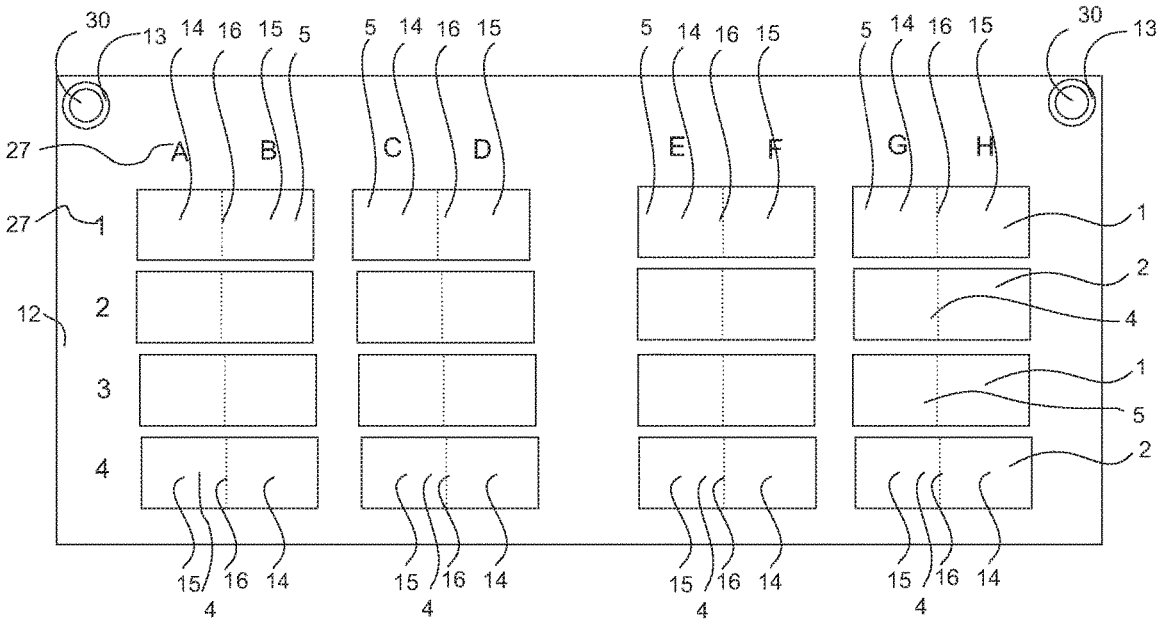

FIG. 21 show a face view of the same as 18B except with smaller gaps and larger gaps and sixteen magnets with rows and columns labeled.

Figure 22:
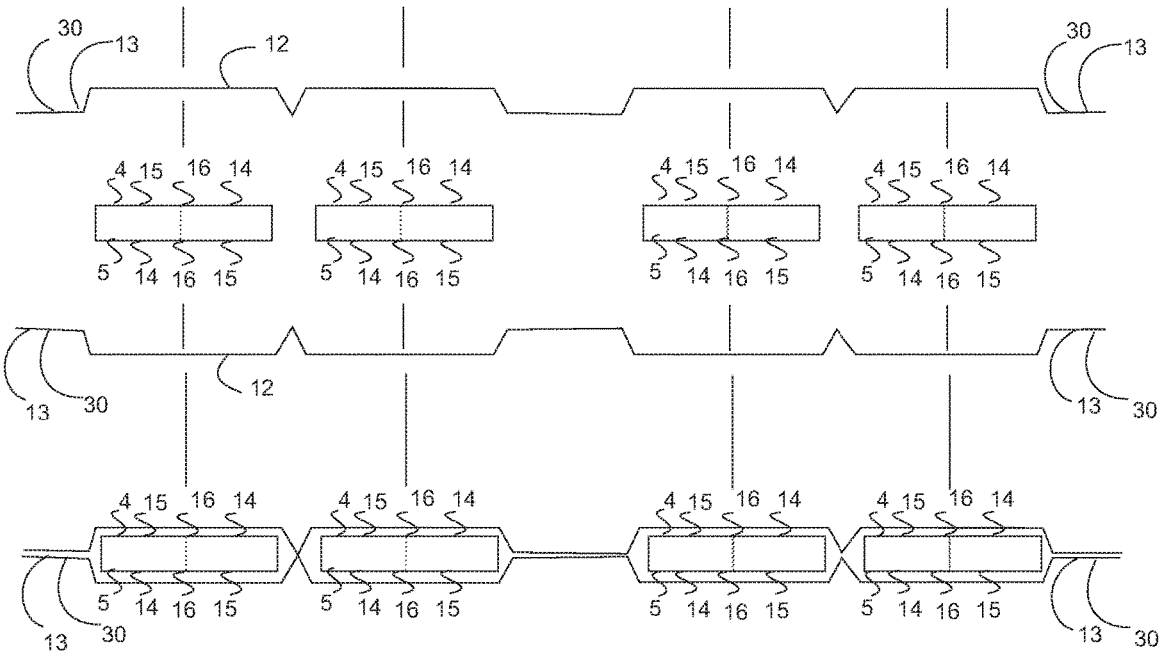

FIG. 22 shows a side view of the 21.

Figure 23:
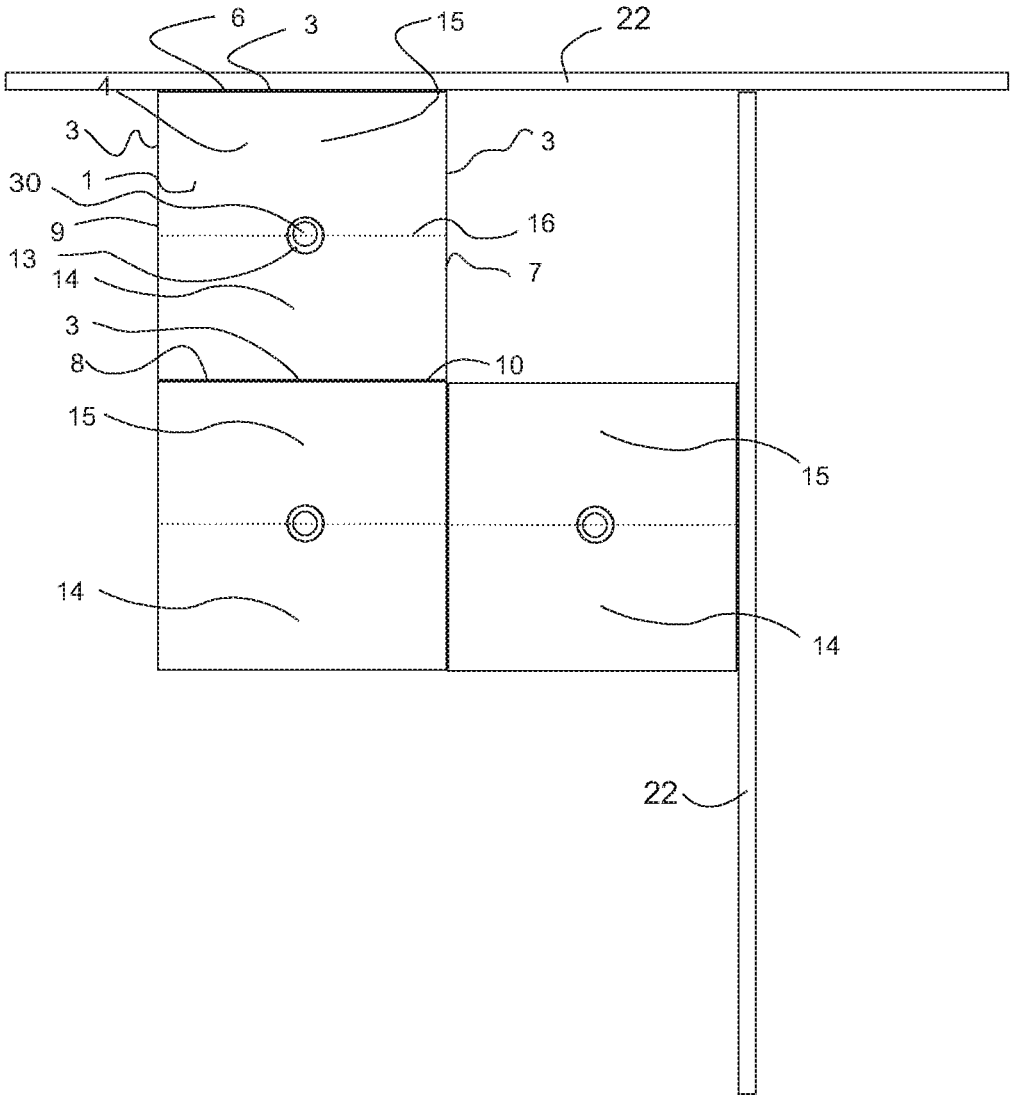

FIG. 23 shows an face view with magnets bolted to make a fixture for welding or gluing.

Figure 24A:
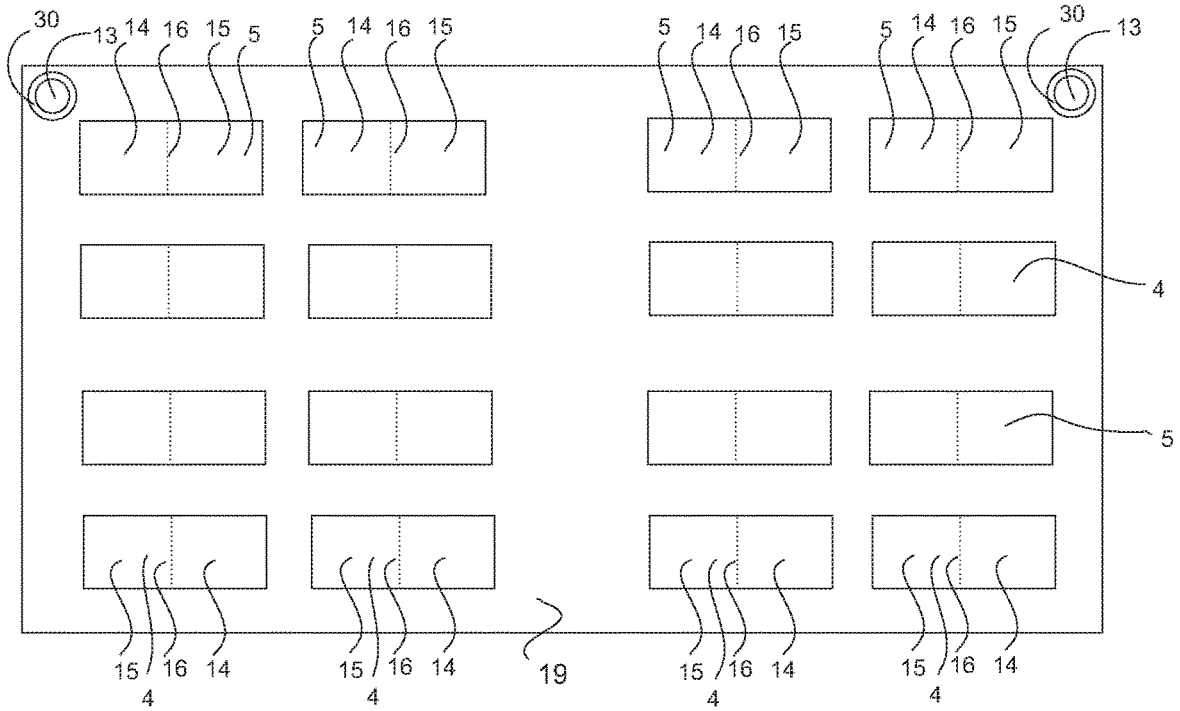

FIG. 24A shows a face view of the same as 21 except with larger gaps.

Figure 24B:
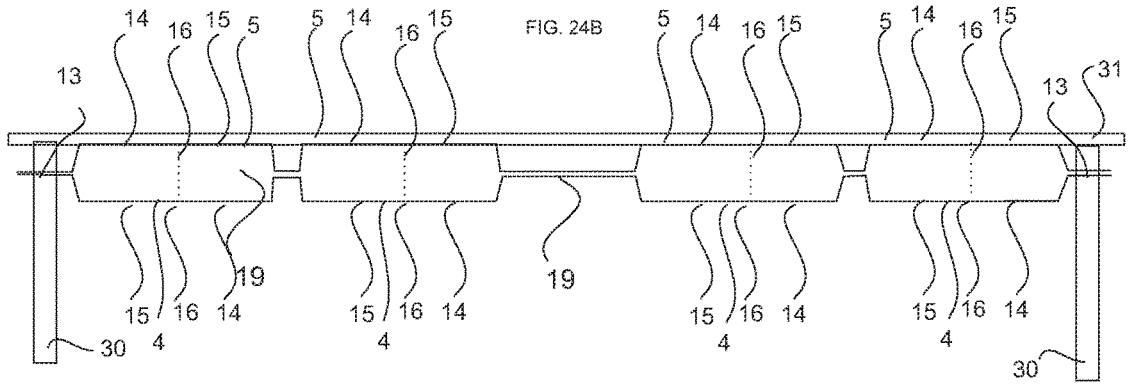

FIG. 24B shows a side view of 24A being held on post hooks on a pegboard mechanically.

Figure 24C:
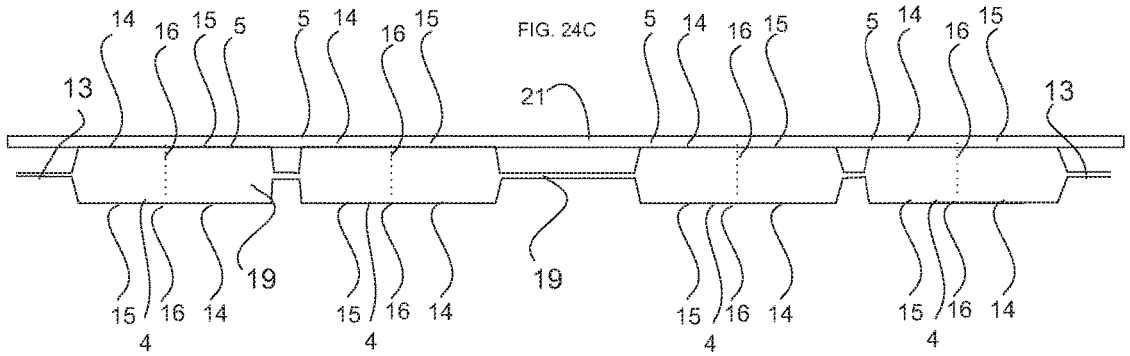

FIG. 24C shows a side view of 24A being held on FMS magnetically.

Figure 25A:
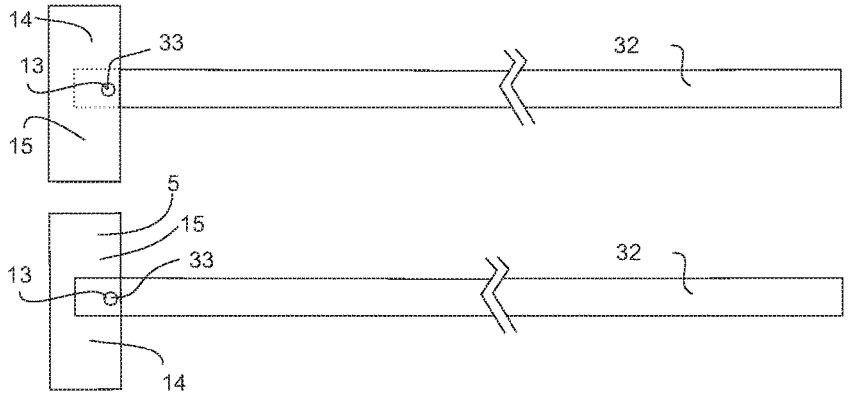

FIG. 25A shows a face view of the system affixed to a stick by the through holes to make a magnetic pick up.

Figure 25B:
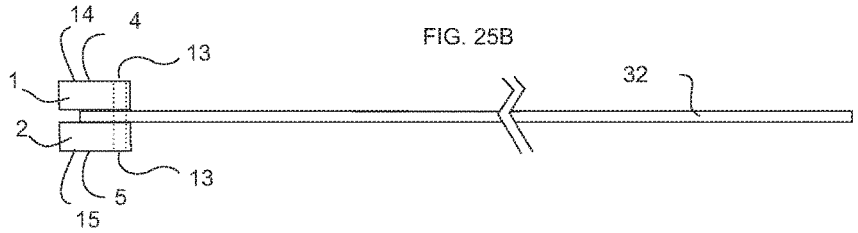

FIG. 25B shows a side view of the system affixed to a stick by the through holes to make a magnetic pick up.

Figure 25C:
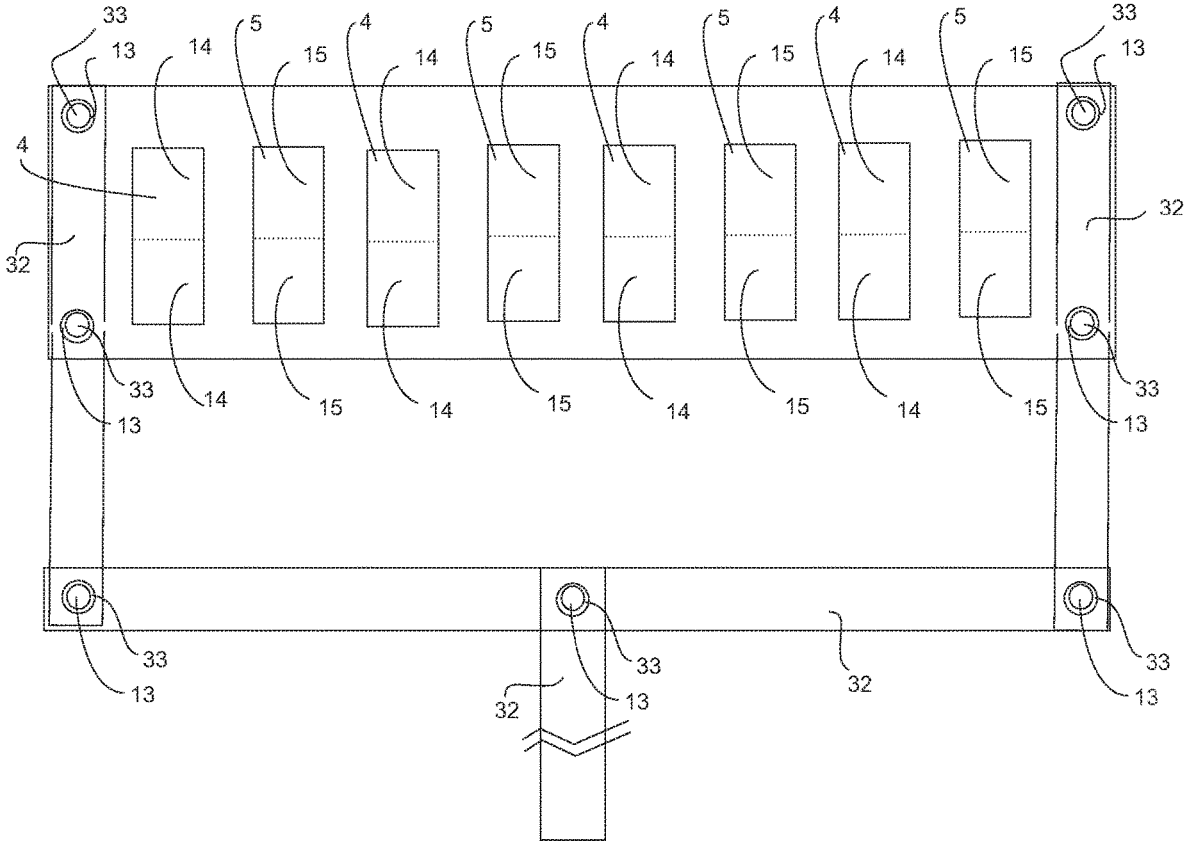

FIG. 25C shows a face view of the system affixed to a stick by the through holes to make a magnetic sweeper.

Figure 26:
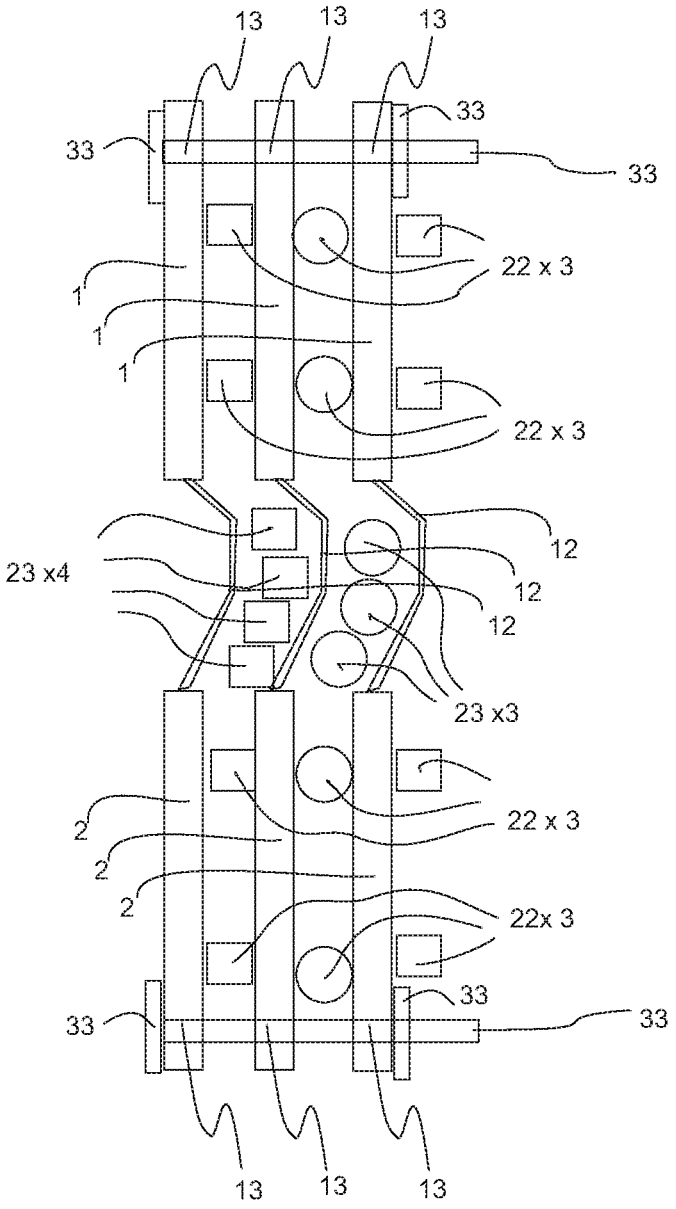

FIG. 26 shows a side view of a preferred embodiment of the system with the flexible non magnetic connect gap material being affixed on the third side of the first magnet and first side of the second magnet thereby forming a hinge pouch stacked in the Z axis on two bolts with nuts.

Figure 27A:
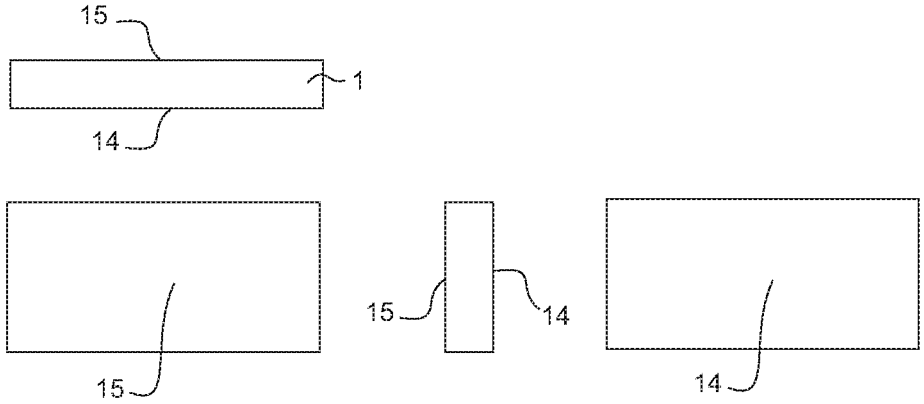

FIG. 27A shows a side, face, side, face view of a magnet with one pole one face.

Figure 27B:
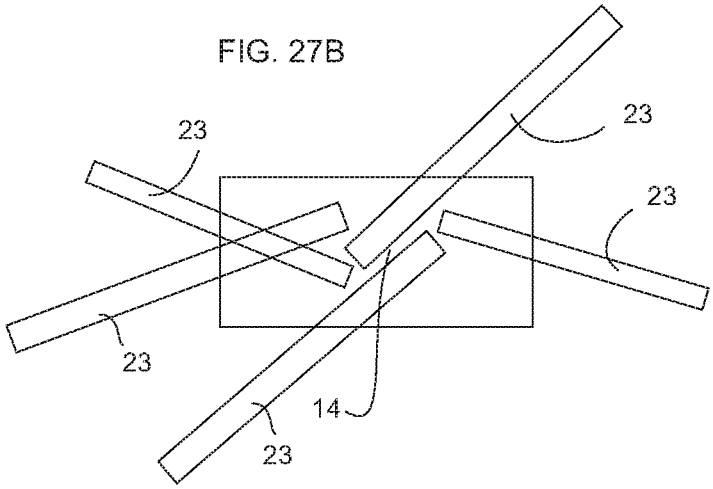

FIG. 27B shows a first face view of a magnet with one pole one face and the FMPs non-aligned parallel due to the polarity.

Figure 27C:
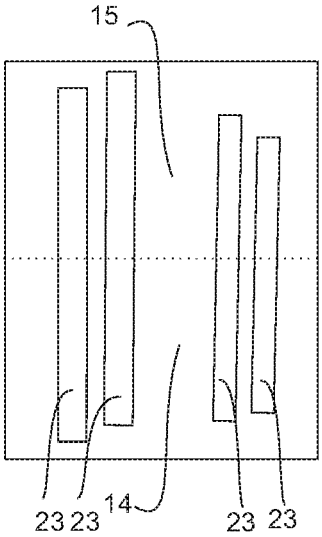

FIG. 27C shows a second face view of a magnet with one pole one face.

Figure 28A:
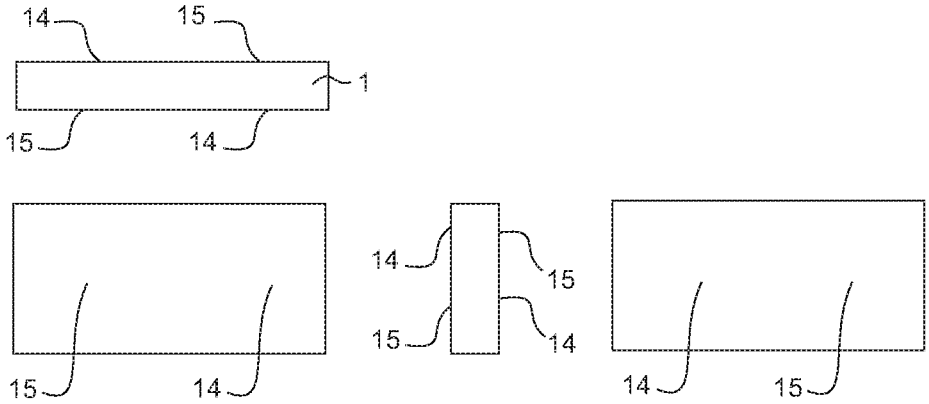

FIG. 28A shows a side, face, side, face view of a magnet with two poles one face.

Figure 28B:
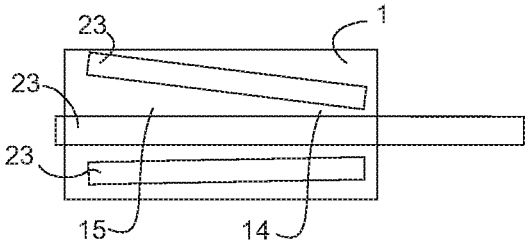

FIG. 28B shows a first face view of a magnet with two poles one face and the FMPs aligned parallel due to the polarity.

Figure 28C:
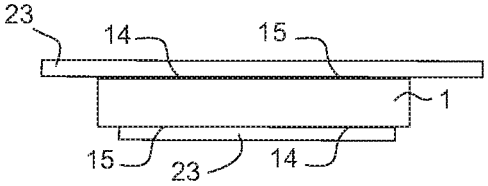
Figure 29A:
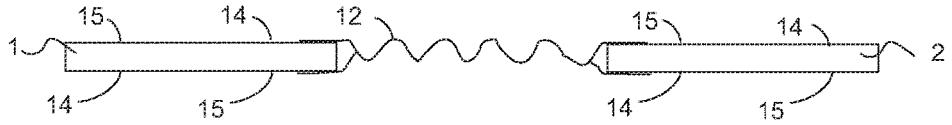
Figure 29B:
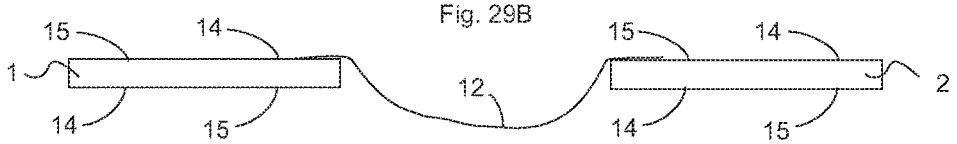
Figure 29C:
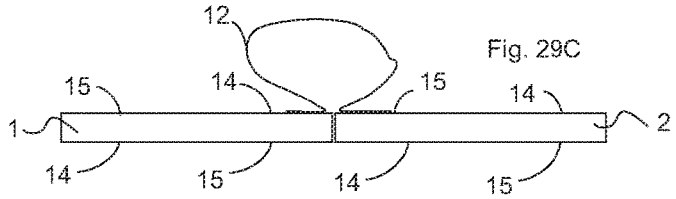
Figure 29D:
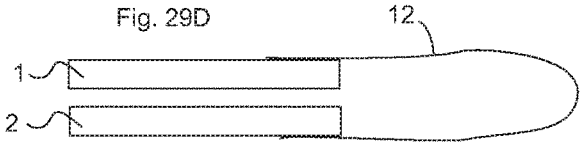
Figure 29E:
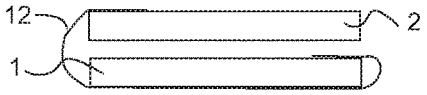
Figure 29F:
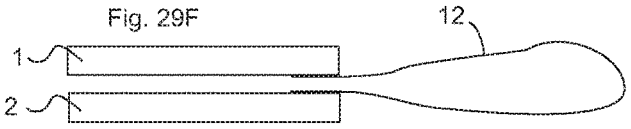
Figure 29G:
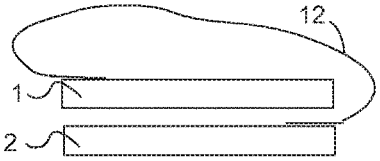
Figure 29H:
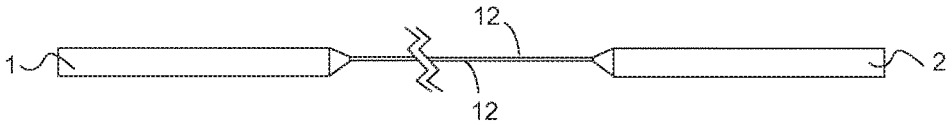
Figure 29I:
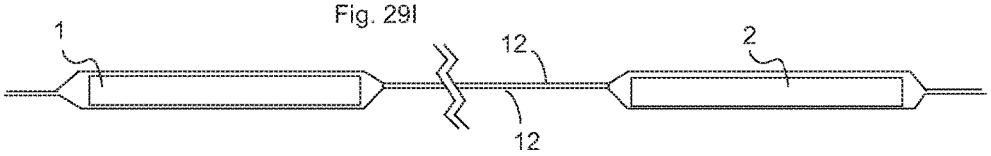

FIG. 28C shows a second face view of a magnet with one pole one face and the FMPs aligned parallel due to the polarity.

FIG. 29A-29I side view of a connector type and magnet positions.

REFERENCE NUMERALS IN DRAWINGS

1 First Magnet
2 Second Magnet
3 Periphery
4 First Face Of Magnet
5 Second Face Of Magnet
6 First Side Of Magnet
7 Second Side of Magnet
8 Third Side of Magnet
9 Fourth Side of Magnet
10 Gap
11 Gap Material
12 Flexible Non-Magnetic Gap Connector
13 Through Hole
14 North Pole
15 South Pole
16 Zero Line Between North and South Poles
17 Flexible Magnet First Magnet Portion
18 Flexible Magnet Second Magnet Portion
19 Flexible Magnet
20 Flexible Gap Connector Portion
21 Ferromagnetic Surface (FMS)
22 Ferromagnetic Piece (FMP)
23 Non Magnetic Piece (NMP)
24 Peg Board
25 Peg Board Hole
26 Closable C Ring
27 Row and Column Labels
28 First Magnet Four Poles Each Face
29 Second Magnet Four Poles Each Face
30 Post Hook
31 Wall
32 Stick
33 Fastener

DESCRIPTION

FIGS. 1A-1D, 8—Preferred Embodiment

Figure 1A:
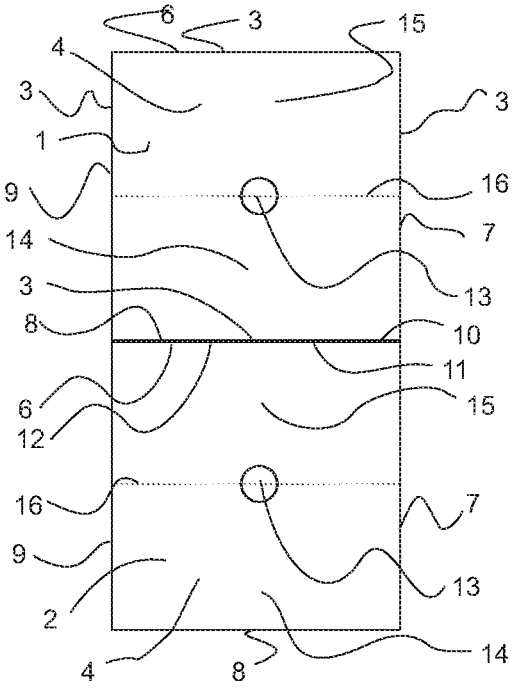
FIG. 1A shows a face view of a permanent magnetic system preferred embodiment.
Figure 1B:
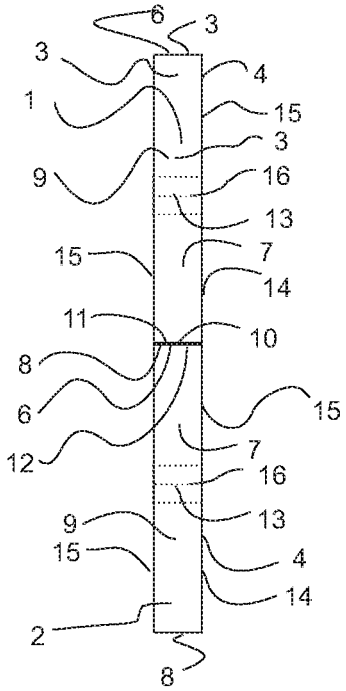
FIG. 1B shows a side view of a permanent magnetic system preferred embodiment.
Figure 8:
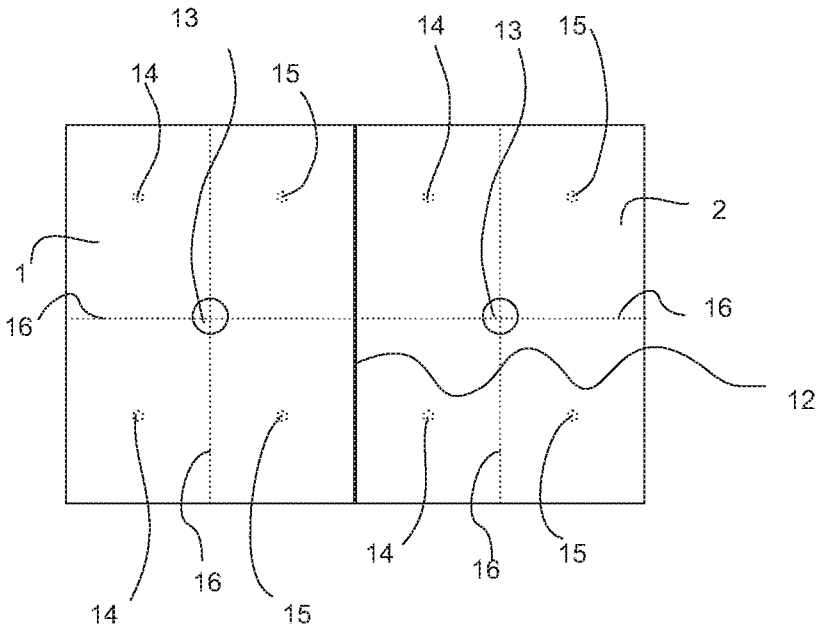
FIG. 8 shows a face view of the preferred embodiment with four pole magnets.
Figure 9:
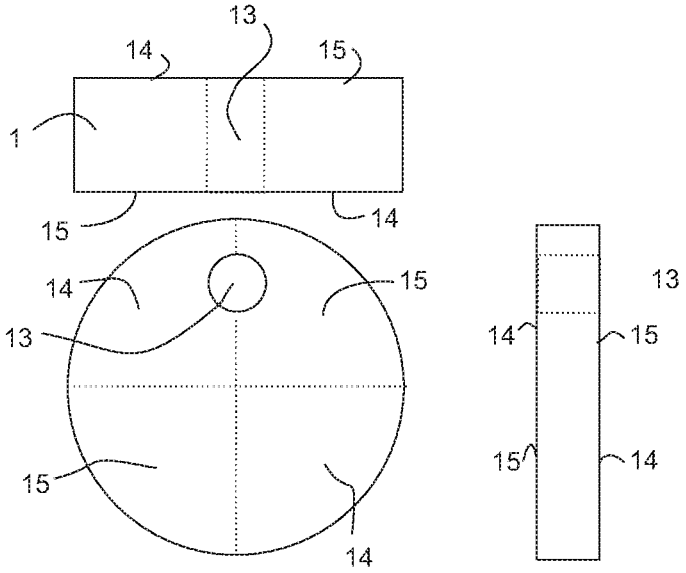
FIG. 9 shows a face view of a alternate embodiment with four pole magnets.
Figure 10A:
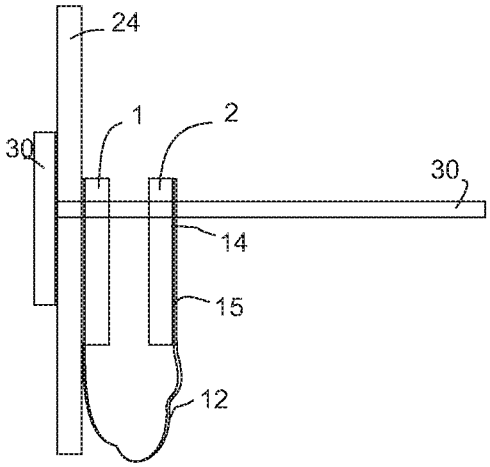
FIG. 10A shows a side view of the preferred embodiment with four pole magnets, in one operational position on a FMS that is also a peg board post hook.
Figure 10B:
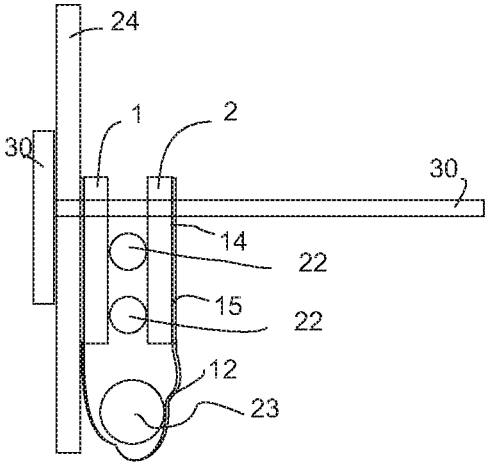
FIG. 10B shows a side view of the preferred embodiment with four pole magnets, in one operational position on a FMS that is also a peg board post hook with FMP and NMP.
Figure 11A:
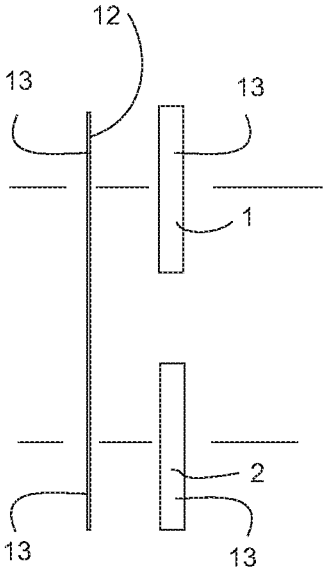
FIG. 11A shows a side view of the preferred embodiment with four pole magnets, in one operational position on a FMS.
Figure 11B:
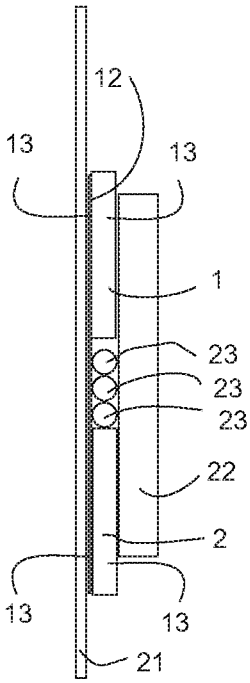
FIG. 11B-11C shows a side view of the preferred embodiment with four pole magnets, in one operational position on a FMS, with FMP and NMP.
Figure 11C:
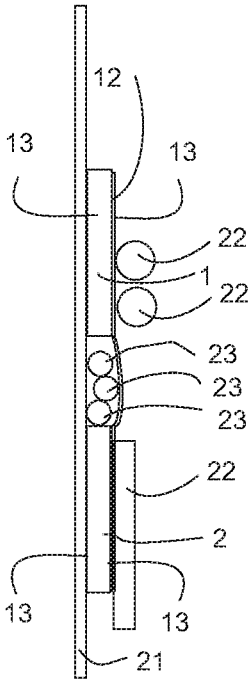
Figure 11D:
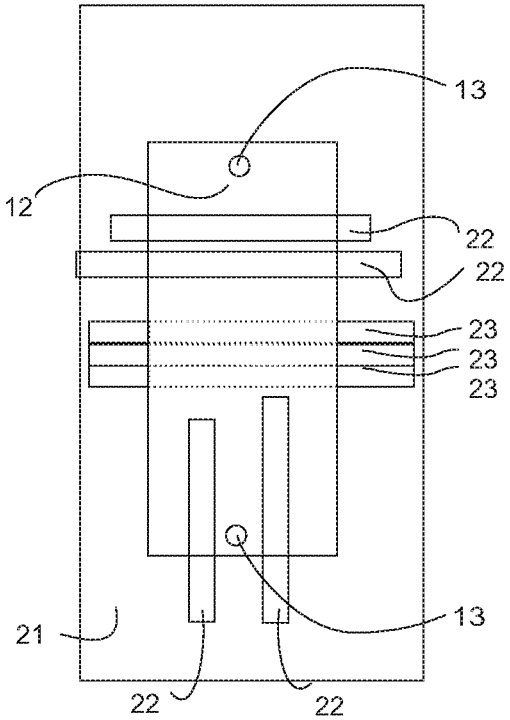
FIG. 11D shows a face view of the preferred embodiment with four pole magnets, in one operational position on a FMS, with FMP and NMP.
Figure 12A:
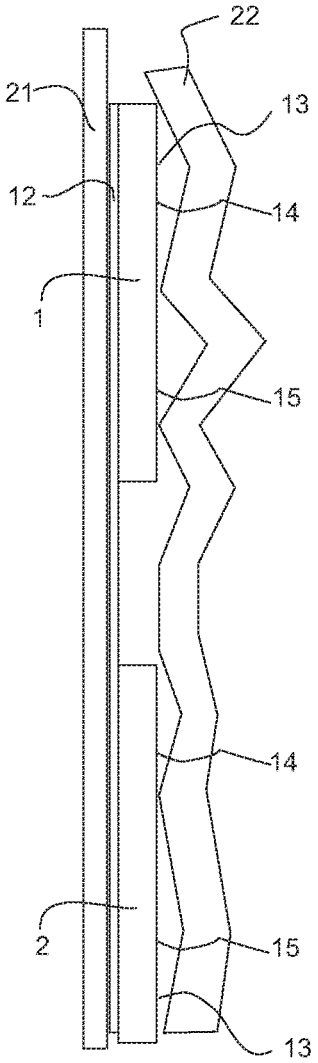
FIGS. 12A and 12B shows a side view of the preferred embodiment with four pole magnets, in one operational position on a FMS, with FMP and NMP.
Figure 12B:
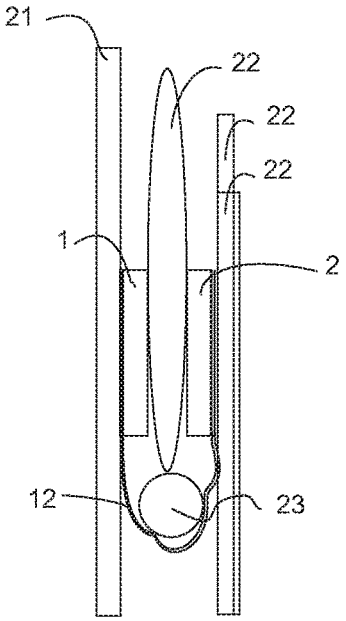
Figure 12C:
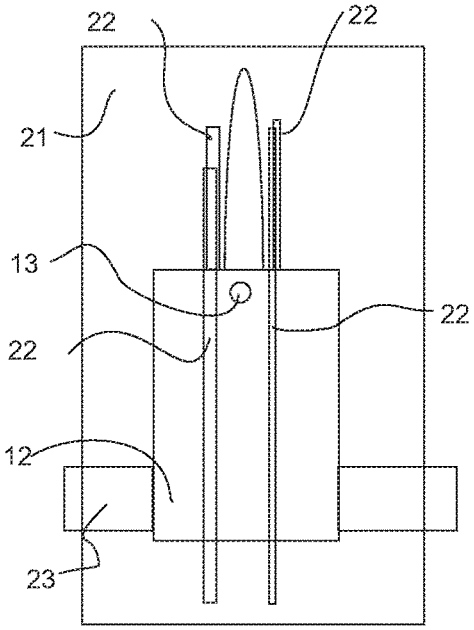
FIG. 12C shows a face view of the preferred embodiment with four pole magnets, in one operational position on a FMS, with FMP and NMP.

A preferred embodiment of the system of the present invention is illustrated by FIG. 1A (face view), FIG. 1B (side view) and FIG. 8 (face view). The system comprising a tile shaped first magnet 1 which has two generally rectangular faces, a first face 4 and a second face 5. Each face comprising at least two poles, a north pole 14 and a south pole 15. The first magnet also comprising a first side 6, a second side 7, a third side 8 and a fourth side 9. A second magnet 2, which is the same as the first magnet 1. The first magnet 1 is connected side to side to the second magnet 2. The connector means is the magnetic attraction between two magnets 1 and 2 a flexible magnetic gap connector 10. Flexible magnetic gap connector 10 holds the magnets 1 and 2 in parallel alignment. The preferred gap 11 distance is only a crack. This size gap 11 provides the maximize hold on a thin FMS 21 or thin FMP 22. The preferred flexible non magnetic gap connector 12 is not attached to the magnets 1 and 2 if the system is used to hold to a flat thin FMS 21, flat thin FMP 22 and no NMP 23. Each system being preferred to have two through holes 13, as mechanical means for holding, disposed either through the magnets or the flexible non magnetic gap connector 12. Each system gap 11 and through hole 13 placement being adjustable by the factory and by the user as determined by the application.

Figure 1C:
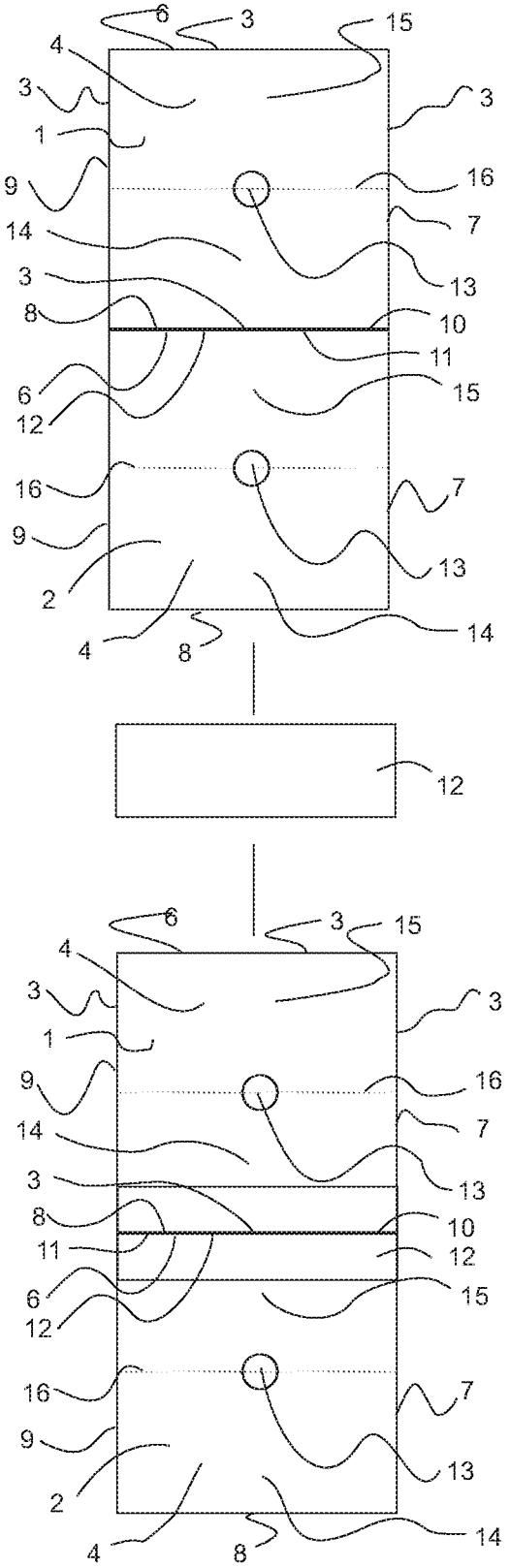
FIG. 1C shows a face expanded view of a permanent magnetic system preferred embodiment.
Figure 1D:
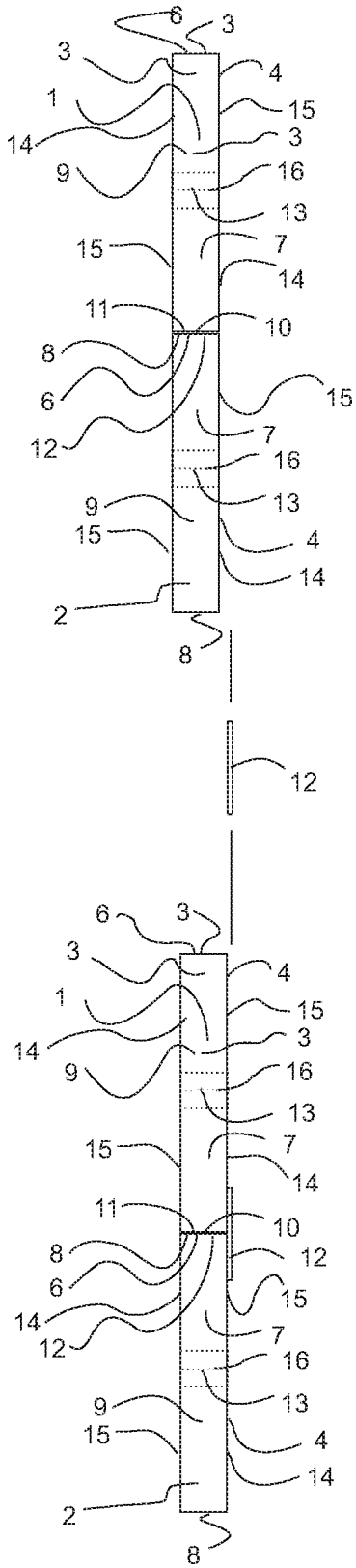
FIG. 1D shows a side expanded view of a permanent magnetic system preferred embodiment.

Another preferred embodiment of the system of the present invention is illustrated by FIG. 1C (face view) and FIG. 1D (side view). The system is the same the previous system except:

a) The connector means is at least one flexible non magnetic gap connector 12. The flexible non magnetic gap connector 12 will be as thin as possible and as durable as possible and as flexible as possible.

b) The preferred gap 11 distance is only a crack to maximize hold on a thin curved FMS 21 or thin curved FMP 22. The preferred flexible non magnetic gap connector 12 is attached to magnets 1 and 2 to allowing them to flex and hold to a curved FMS 21 and curved FMP 22.

Figure 1E:
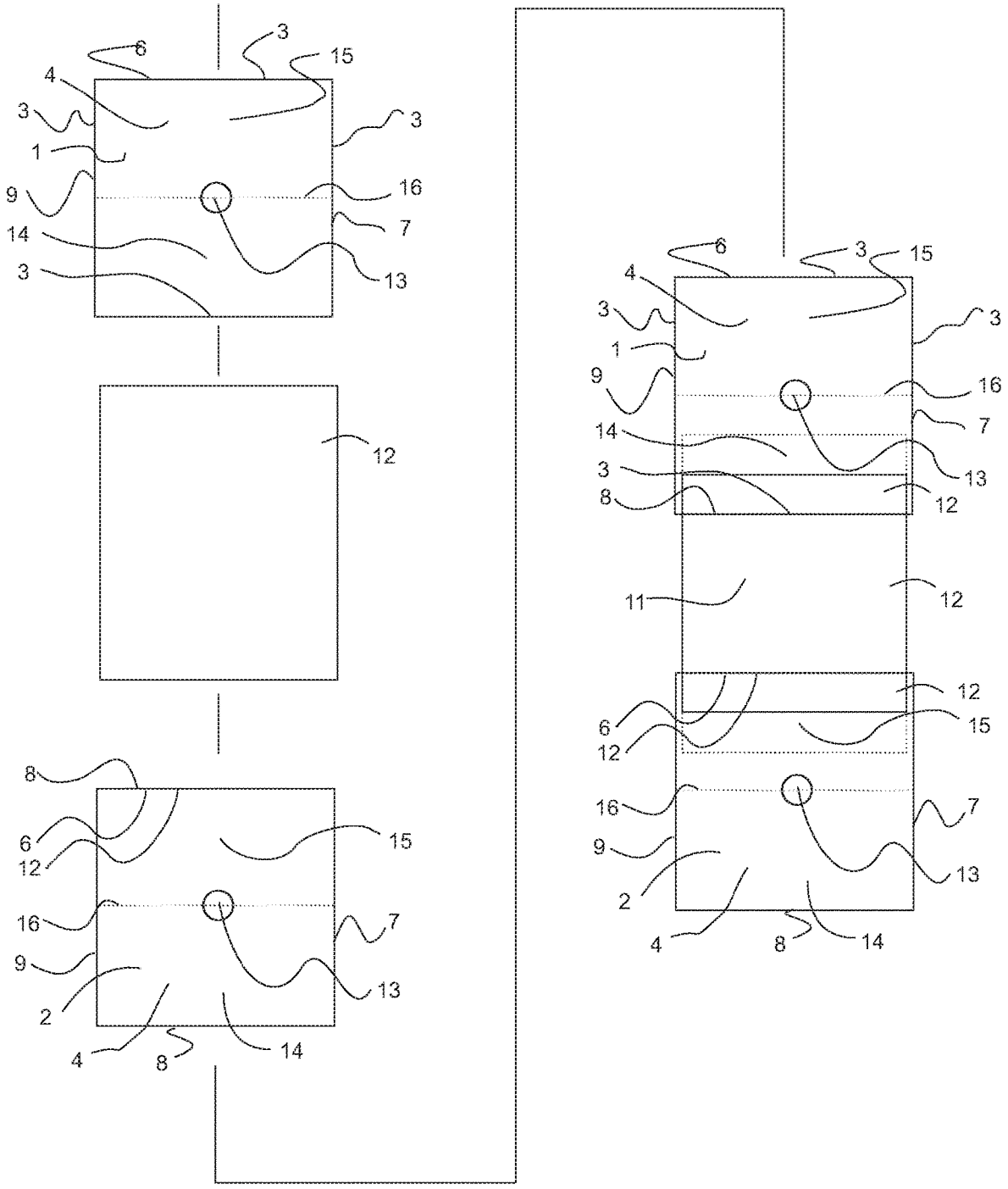
FIG. 1E shows a face expanded view of a permanent magnetic system preferred embodiment.
Figure 1F:
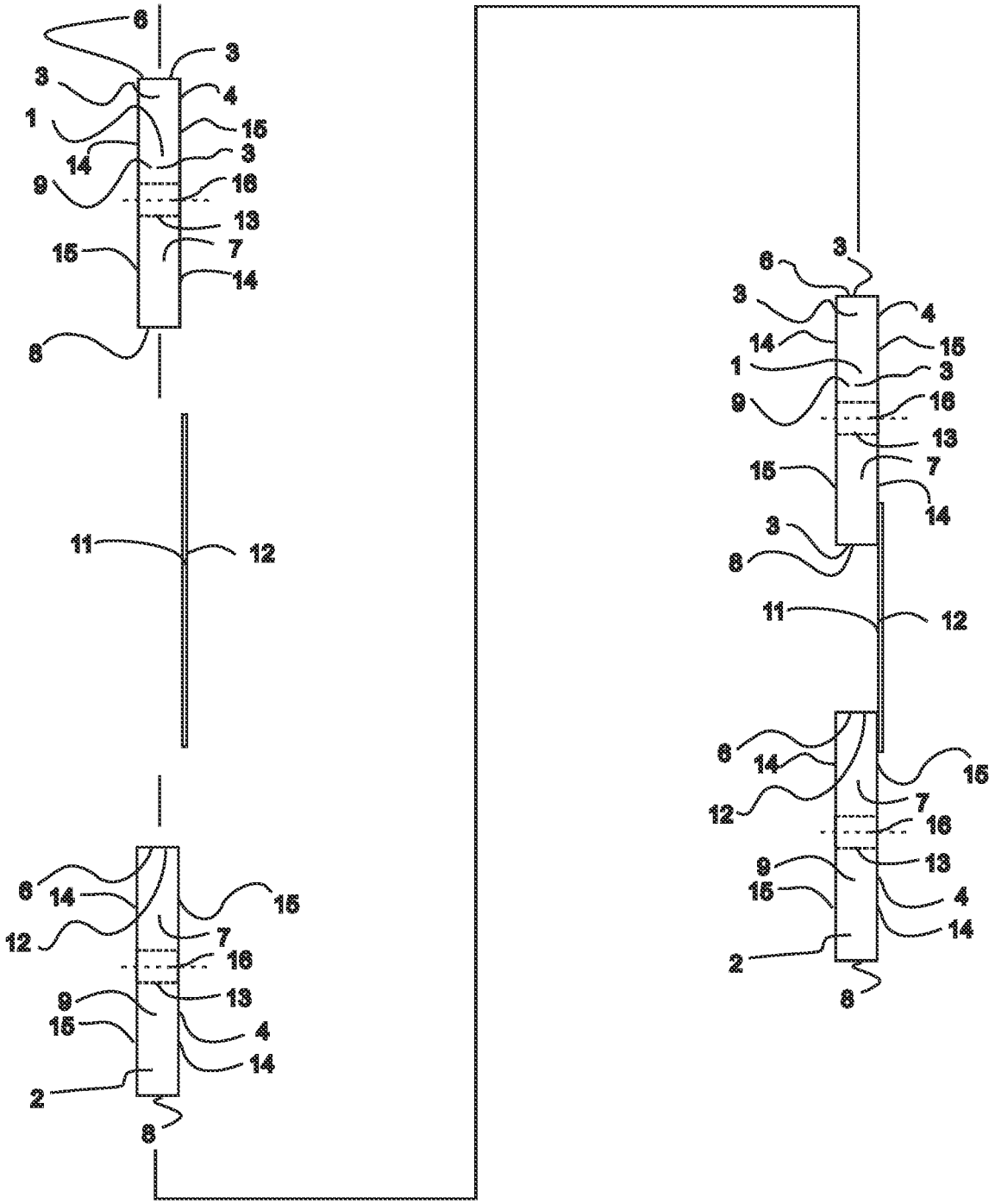
FIG. 1F shows a side expanded view of a permanent magnetic system preferred embodiment.

Another preferred embodiment of the system of the present invention is illustrated by FIG. 1E (face view) and FIG. 1F (side view). The system is the same the previous system except:

a) The connector means is at least one flexible non magnetic gap connector 12.

b) The preferred gap 11 distance is greater to maximize hold on a thick curved contoured FMS 21 or thick curved contoured FMP 22 and to hold NMP 23. The preferred gap 11 distance can be determined as equal to the distance on center from post hook 20 to post hook 20. The preferred gap 11 distance can be determined by the thickness of the FMS 21 and or the FMP 22. The preferred gap 11 distance can be determined to match the contour and curve of the ferromagnetic surface 21 and or the ferromagnetic piece 22 to maximize hold. The preferred gap 11 distance can be determined to match the size of the non-magnetic pieces held by 12.

c) The flexible non magnetic gap connector 12 length and width shall be determined by the following:
   i. the preferred gap(s) 11,
   ii. the length and width of the at least two magnets 1 and 2
   iii. the number of second magnets 2 being connected,
   iv. the distance between the post hooks 20 centers and if the through holes 13 will be disposed in the magnets 1 and 2 or disposed in the flexible non magnetic connector 12 d) The placement of the through holes 13 shall be determined by the post hooks 20 locations. The placement of the through holes 13 shall also be determined by the size of the flexible non magnetic gap connector 12. If there is excess material in the flexible non magnetic gap connector 13 then it is easier to put through holes in that material than in the magnets 13 Assuming the post hooks 20 are 1" apart on center then the size of the gap 11 must be 0", 1", 2", 3" or a multiple of 1". The distance on center from post hook 20 to post hook 20 may also be adjusted by moving the post hooks 20 to adjust the gap 11 to match the FMS and or FMP described above.

Figure 1G:
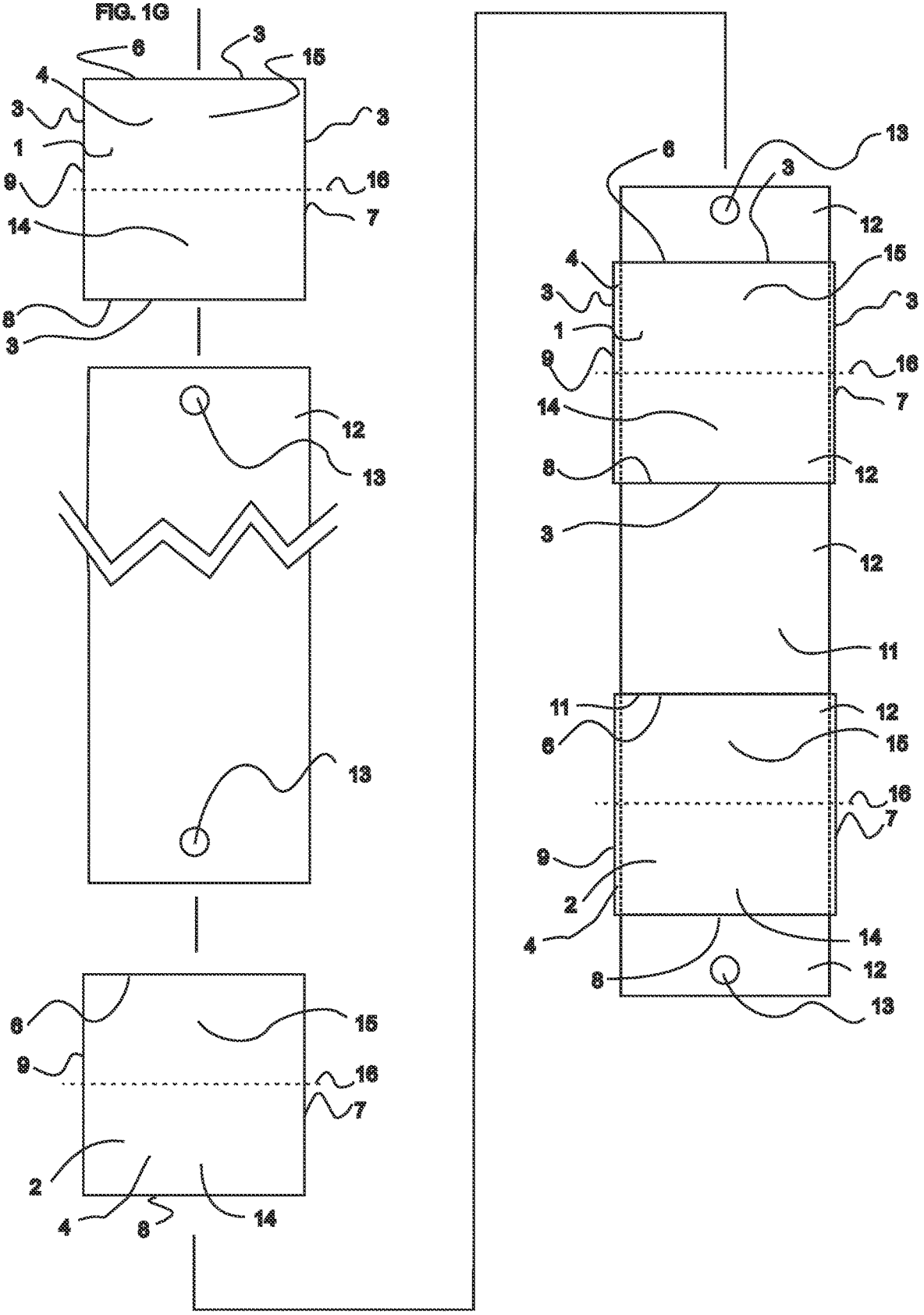
FIG. 1G shows a face expanded view of a permanent magnetic system preferred embodiment.
Figure 2A:
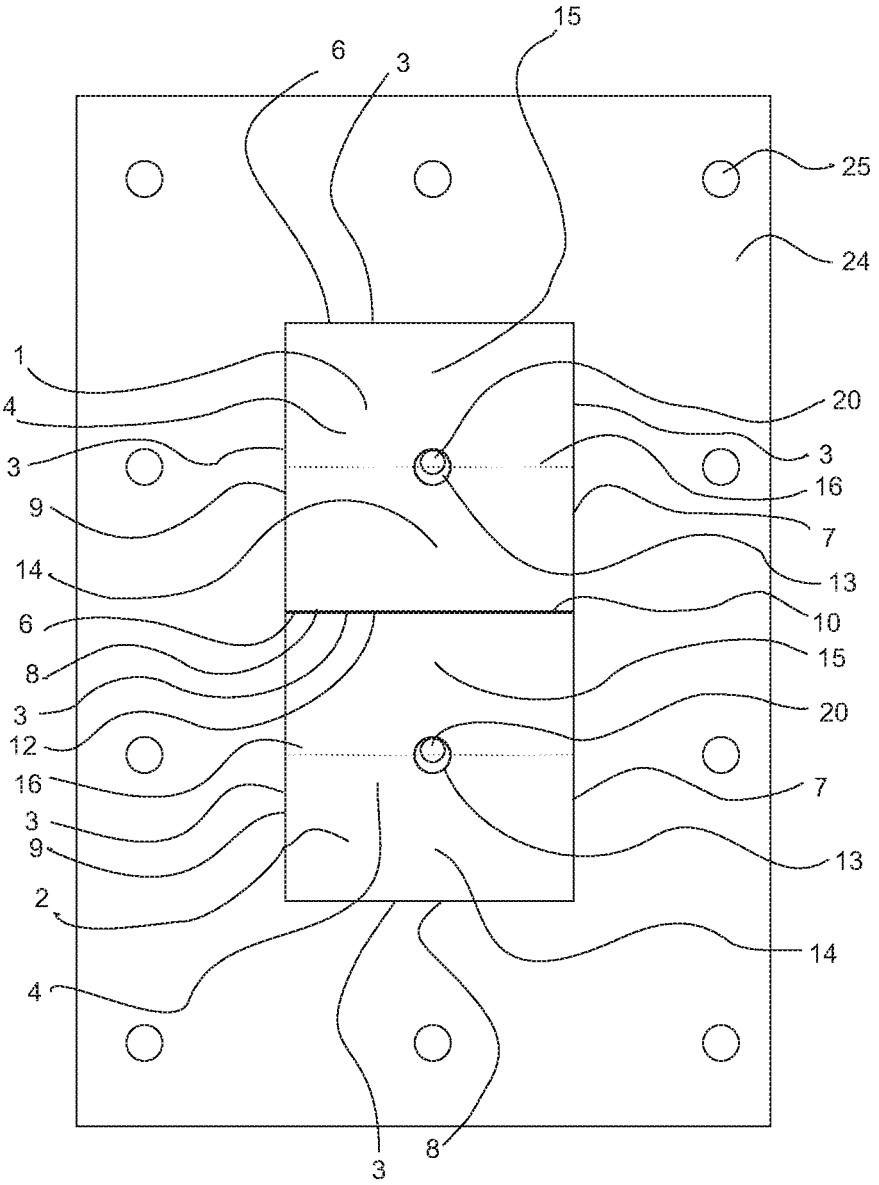
FIG. 2A shows a face view of the preferred embodiment in one operational position on a peg board.
Figure 2C:
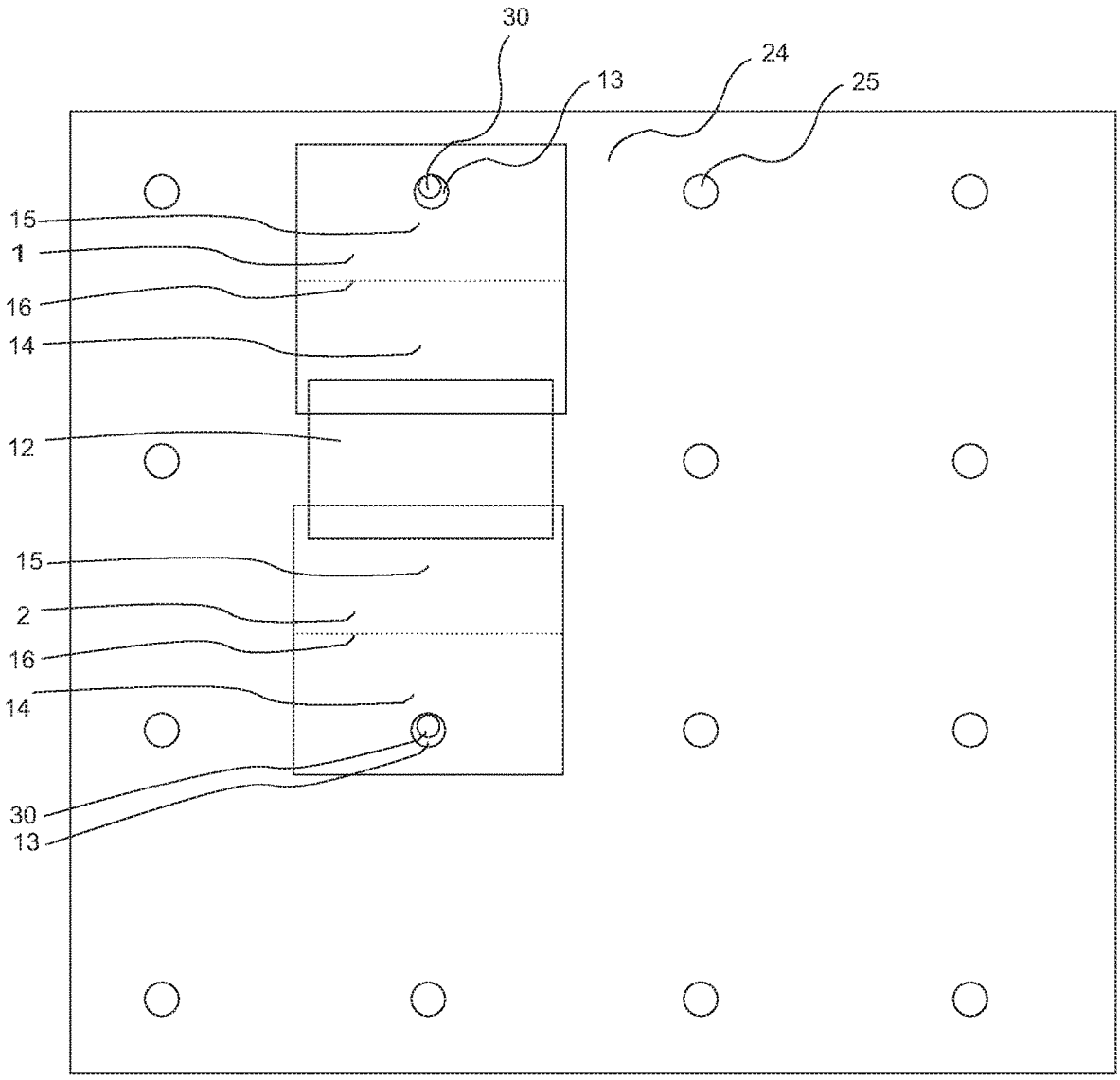
FIG. 2C shows a face view of the preferred embodiment in one operational position on a peg board.
Figure 2D:
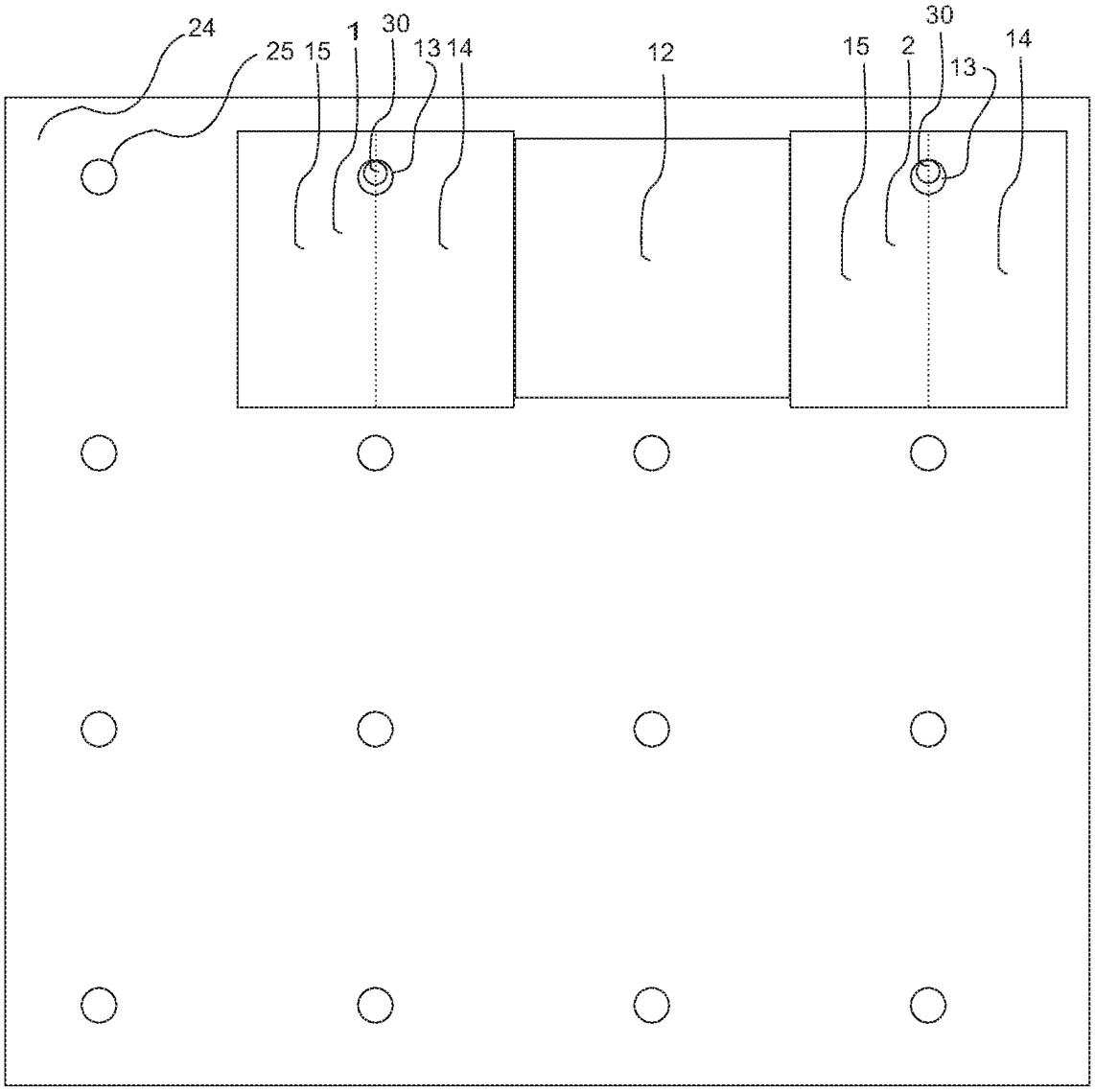
FIG. 2D shows a face view of the preferred embodiment in one operational position on a peg board.
Figure 2E:
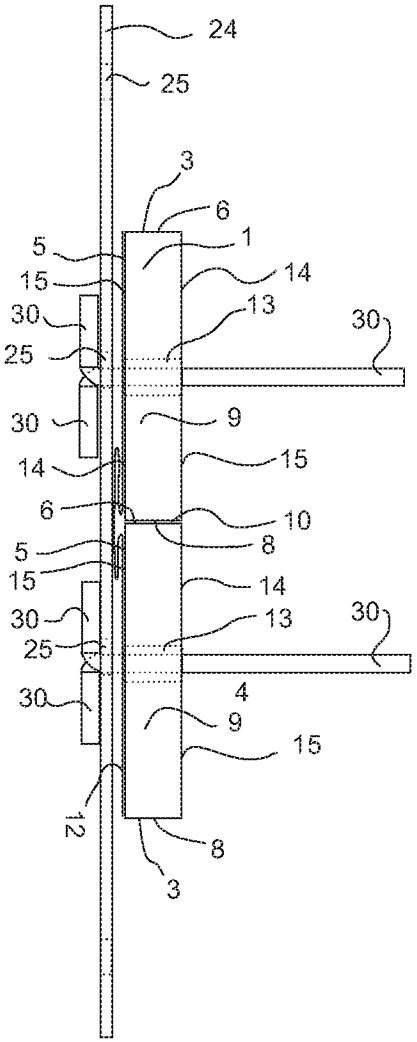
FIG. 2E shows a side view of the preferred embodiment in one operational position on a peg board.
Figure 2F:
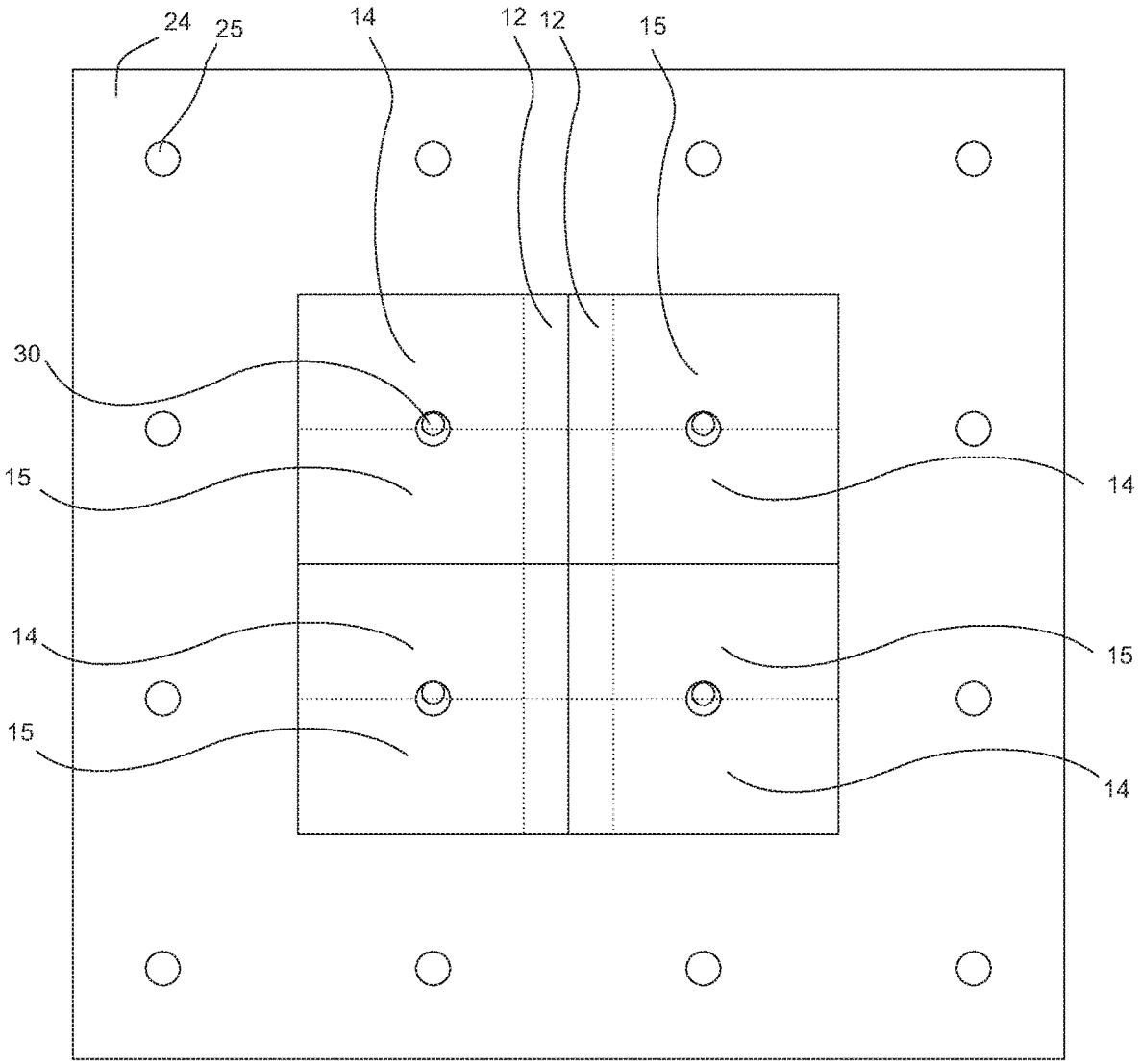
FIG. 2F shows a face view of the preferred embodiment in one operational position on a peg board.
Figure 2G:
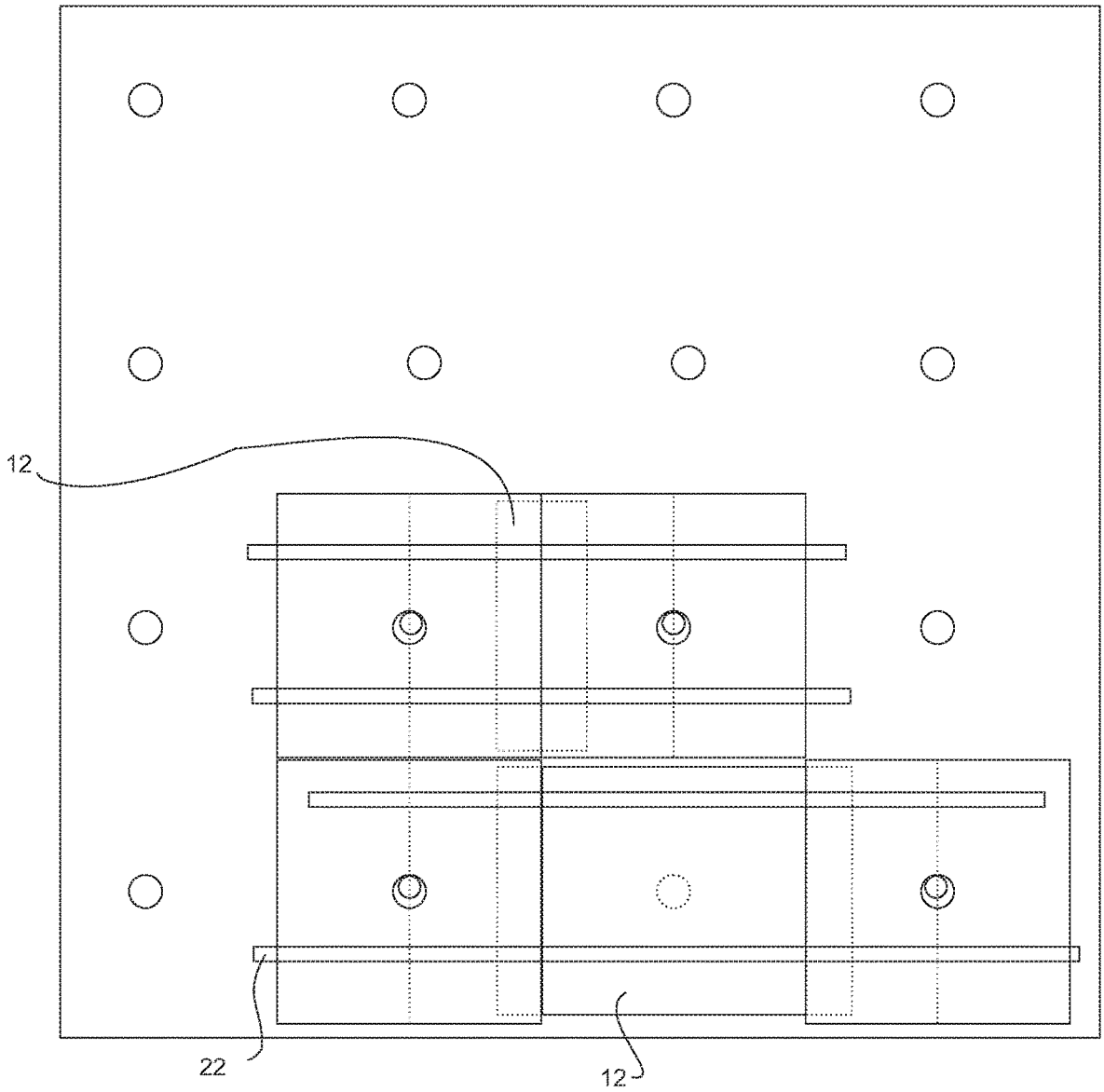
FIG. 2G shows a face view of the preferred embodiment in one operational position on a peg board.
Figure 2H:
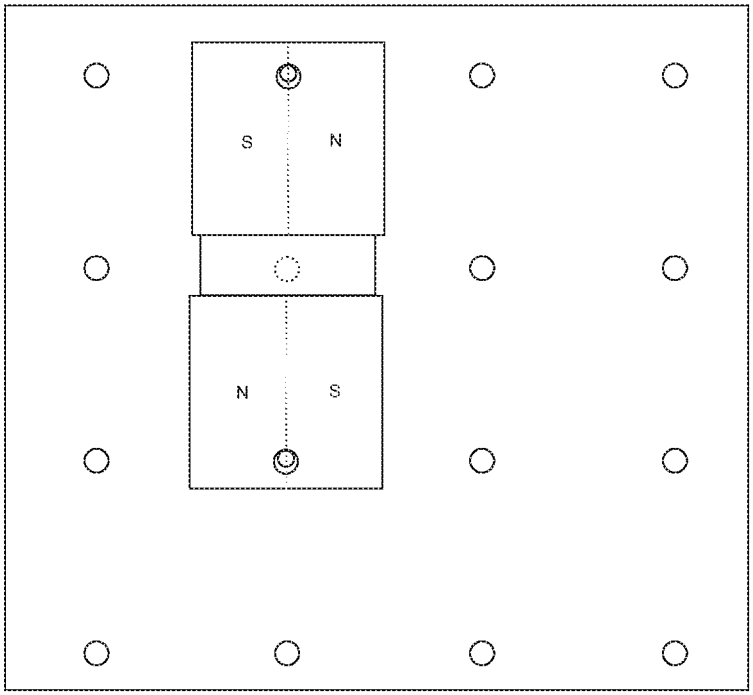
FIG. 2H shows a face view of the preferred embodiment in one operational position on a peg board.
Figure 2I:
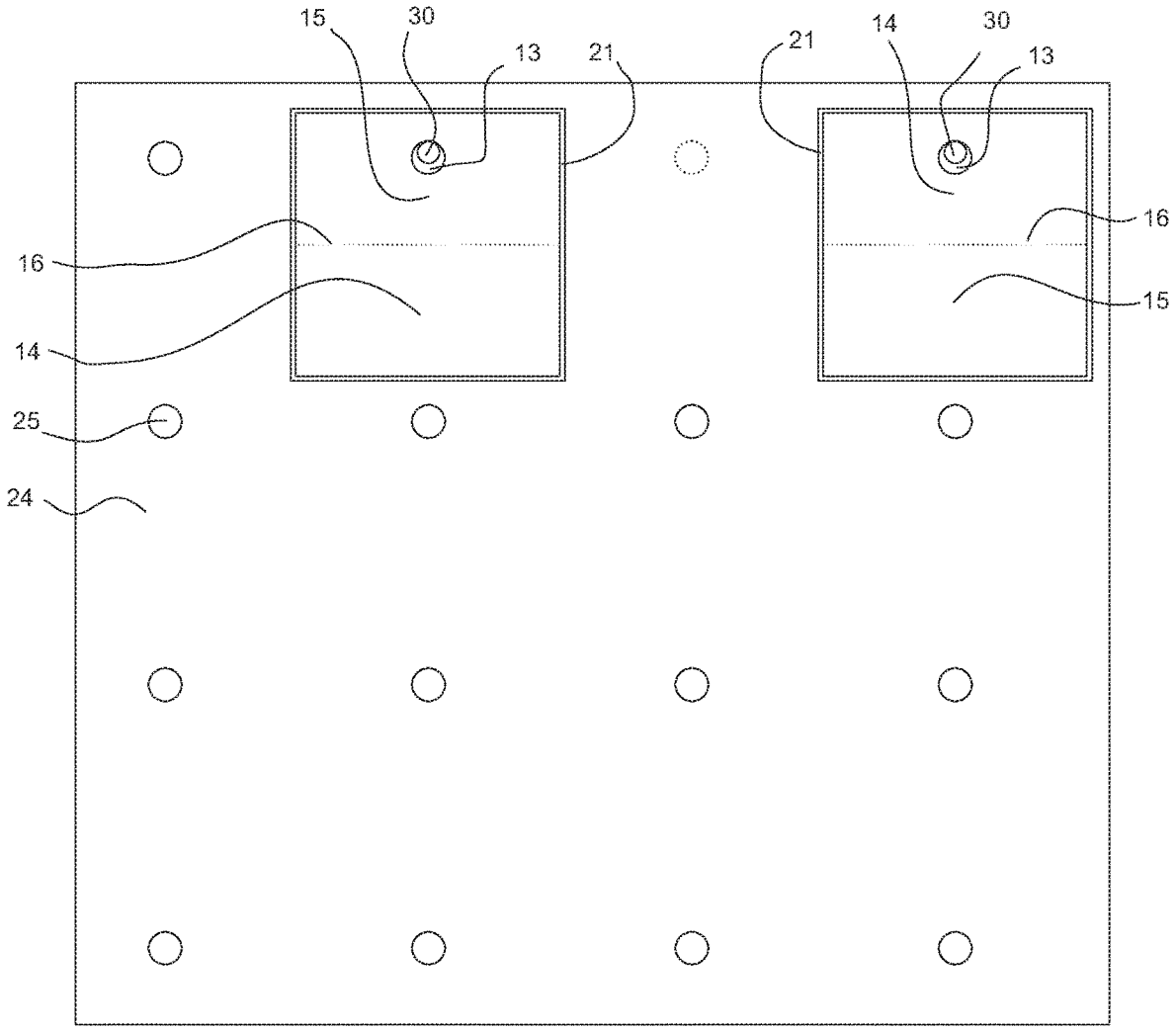
FIG. 2I Shows a face view of an alternate embodiment of the invention in an operational position on a peg board.
Figure 2J:
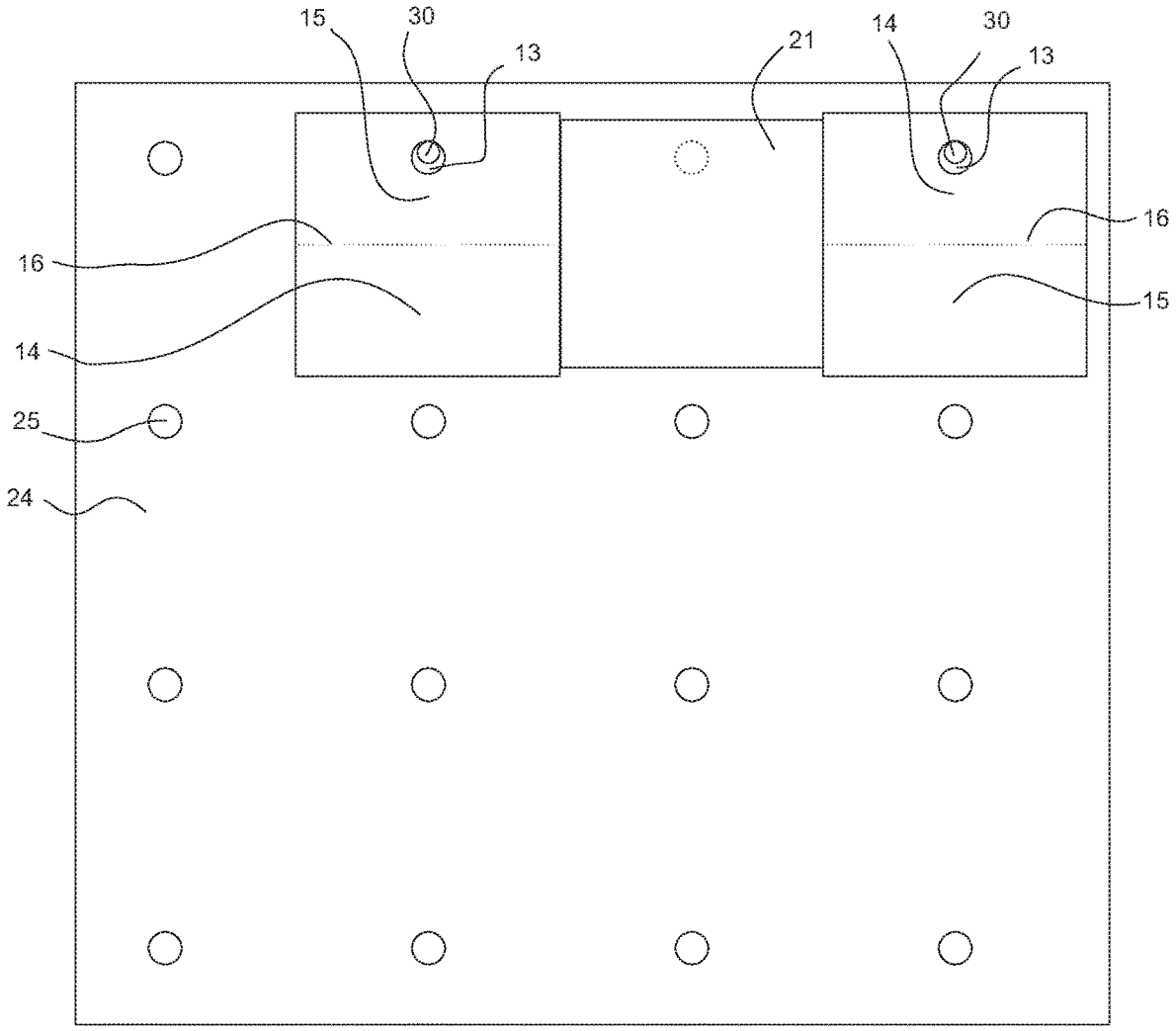
FIG. 2J shows a face view of the preferred embodiment in one operational position on a peg board.

Another preferred embodiment of the system of the present invention is illustrated by FIG. 1G (face view). The same as the previous system except:

a) The magnet 1 and at least one second magnet 2 do not have a through hole.

b) The flexible magnetic gap connector 10 is replaced by the flexible non magnetic gap connector 12. Wherein the flexible non magnetic gap connector 12 is sized larger then the magnet 1 and magnet 2 and the gap 11. The over sized material has dispose therein the two through holes 13 in the flexible non magnetic gap connector 12 instead of the magnet. This means that the magnets 1 and 2 will not be connected by magnetic attraction on the side of the system having excess material with a through hole 13. However, the other sides may still be used for side to side flexible magnetic gap connectors 10.

Figure 13A:
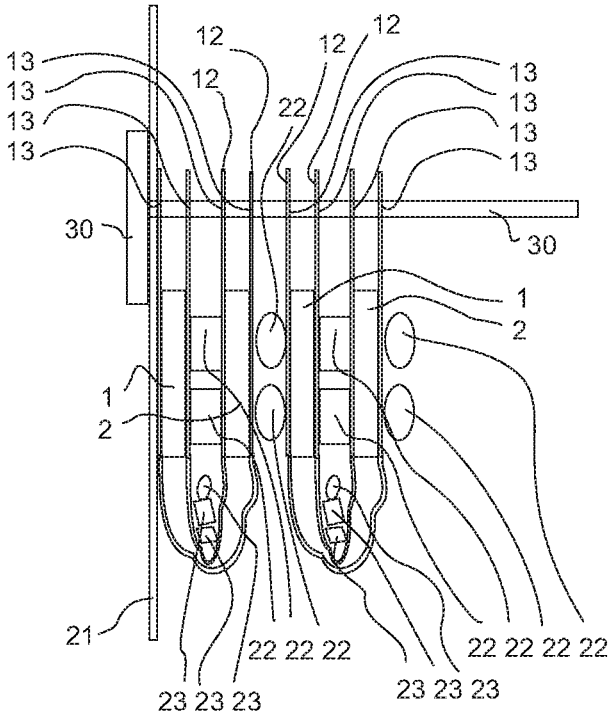
FIG. 13A shows a side view of a system of the preferred embodiment in the closed position on a FMS which is also a pegboard with post hook, holding FMP and NMP.
Figure 13B:
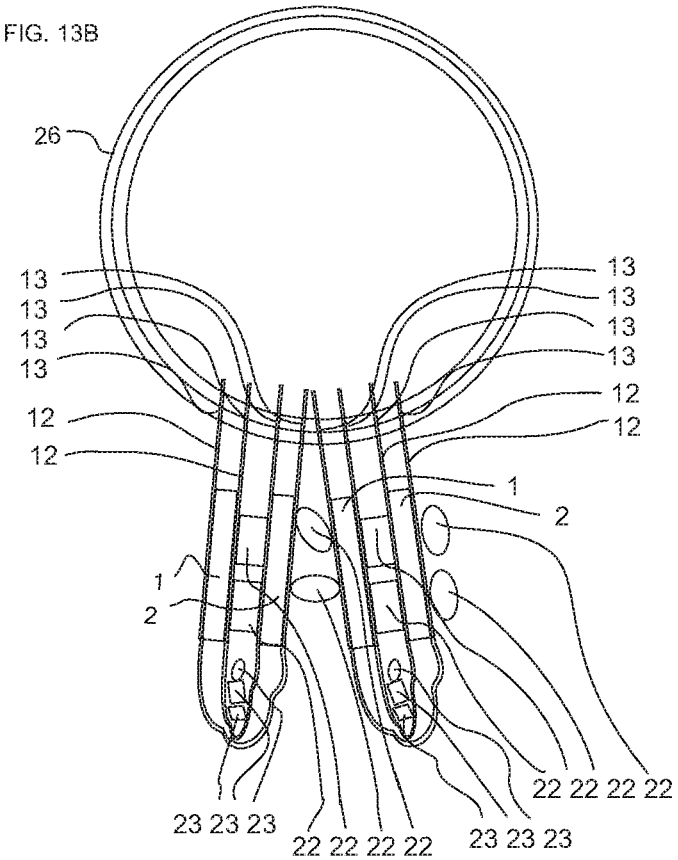
FIG. 13B shows a side view of a system of the preferred embodiment in the closed position on closable C ring holding FMP and NMP.

FIGS. 13B, 19, 20, 21, 22, 23, 24A, 26—Additional Embodiments Additional Embodiments are shown in FIGS. 13B, 19A, 19B, 20, 21, 22, 23, 24A, 26. FIG. 13B shows the preferred embodiment held on a closable C ring. FIG. 19A, 19B shows the preferred embodiment made with one flexible molded magnet 17. FIG. 20 shows four magnets 2 with two poles on each face 4 with a large gap 11 in between each one and four through holes 13. FIGS. 21 and 22 shows and array of two pole magnets with three different gap 11 sizes and through holes in the excess material of the flexible non magnetic gap connector 12. FIG. 23 shows magnets bolted 31 to make a welding or gluing fixture 2 in between two flexible non magnetic gap connectors 12 with two through holes 13 and labels on rows and columns 28. FIG. 24 shows 23 shows and array of magnets 2 in between two flexible non magnetic gap connectors 12 with two through holes 13 made of one piece of molded flexible magnet material. FIG. 26 shows a side view of the preferred embodiment held on two bolts and two nuts.

FIGS. 3A-3F, 9, 16—Alternative Embodiments

Alternative Embodiments are Shown in FIGS. 3A-3F, 9, 16

Figure 3A:
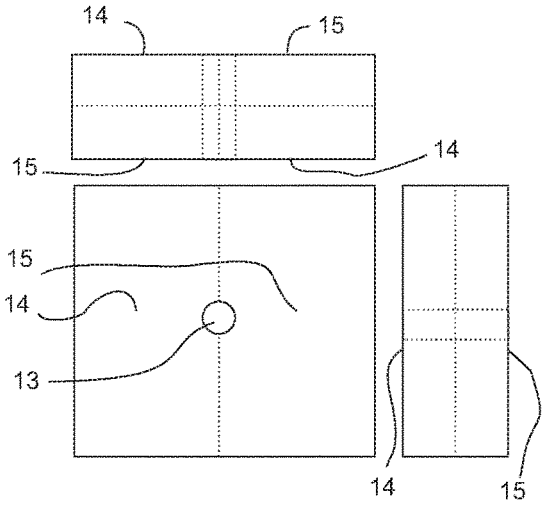
FIG. 3A-3C shows a face view of an embodiment in one operational position.
Figure 3D:
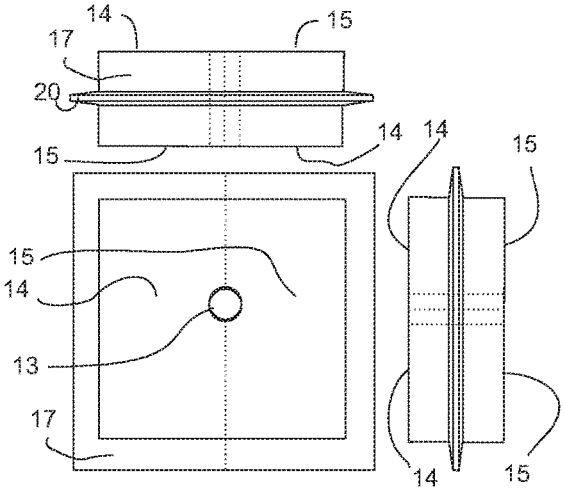
FIG. 3D-3F shows a face view of an embodiment of flexible magnet in one operational position.
Figure 3B:
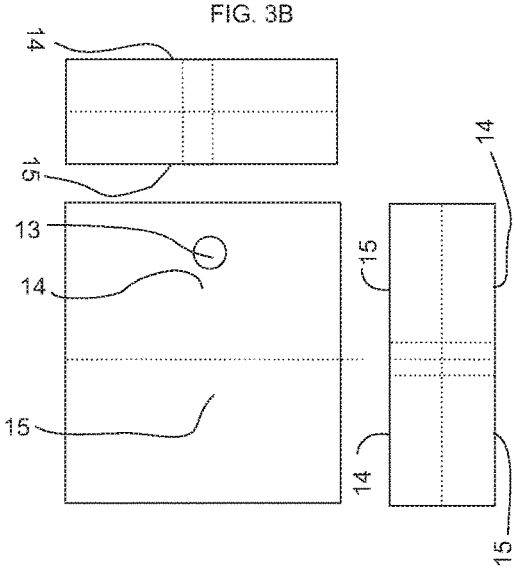
Figure 3E:
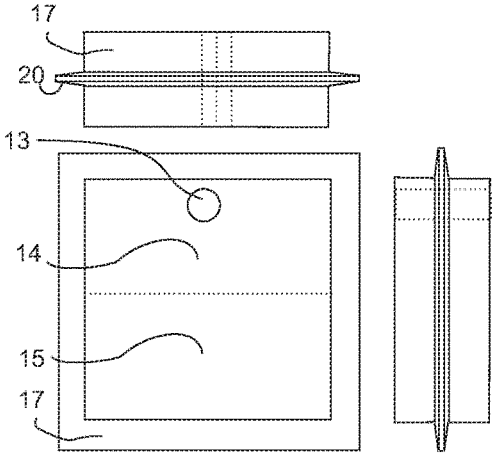
Figure 3C:
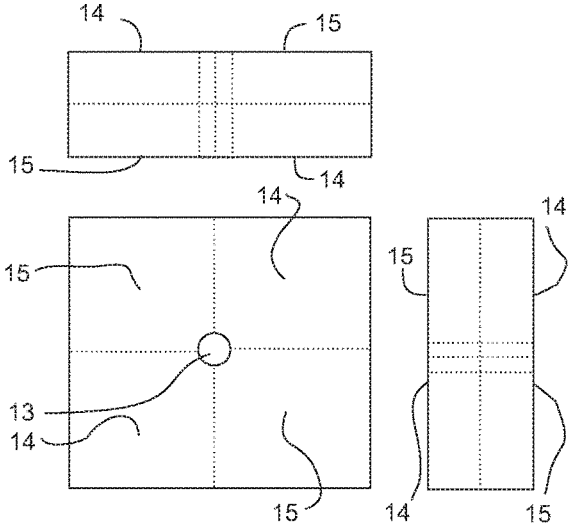
Figure 3F:
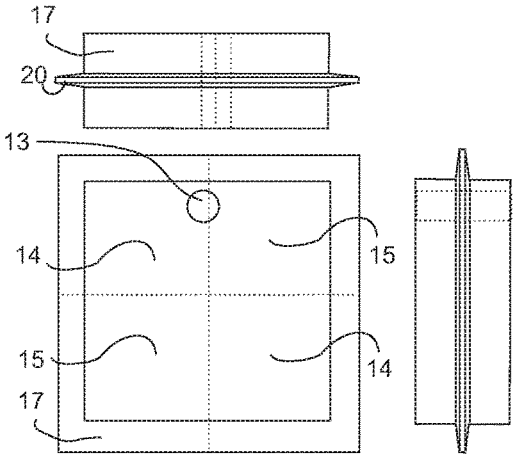
Figure 4A:
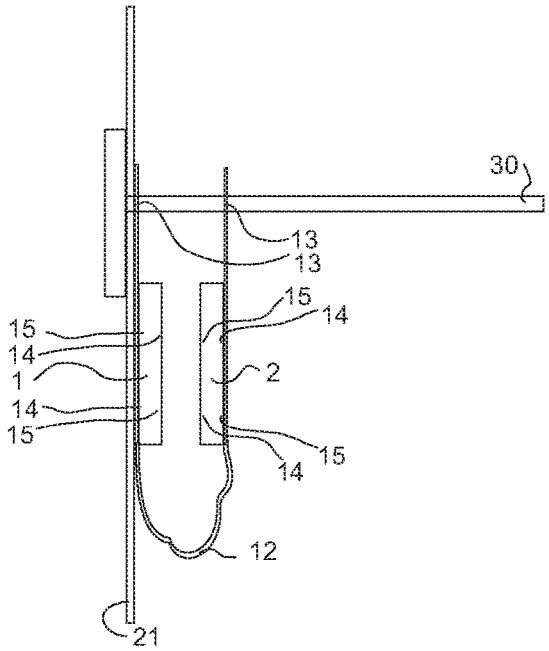
FIG. 4A-4D shows a side view of the preferred embodiment in one operational position on a peg board.
Figure 4B:
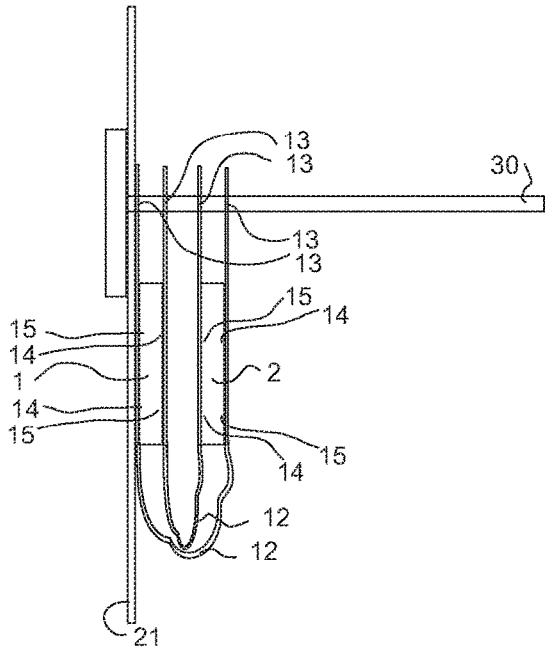
Figure 4C:
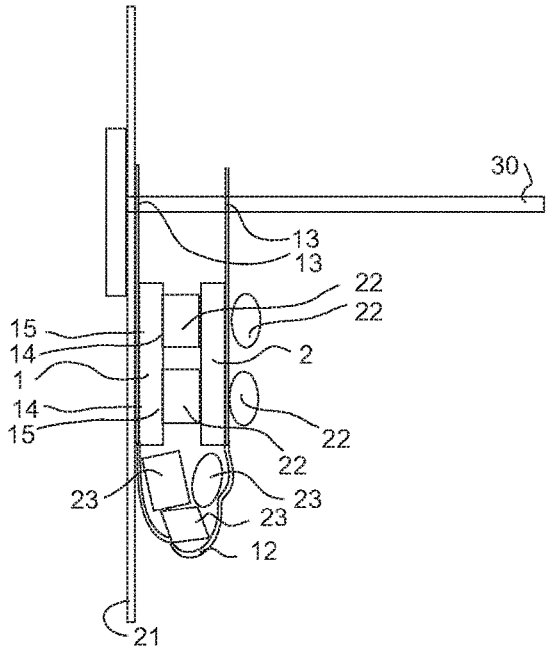
Figure 4D:
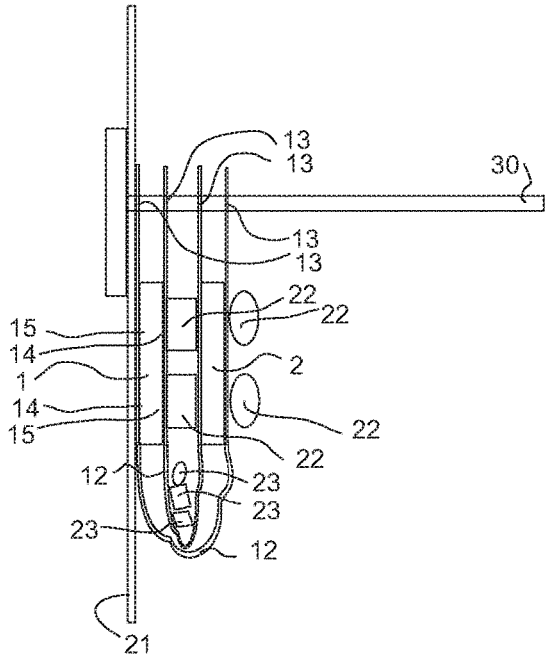
Figure 4E:
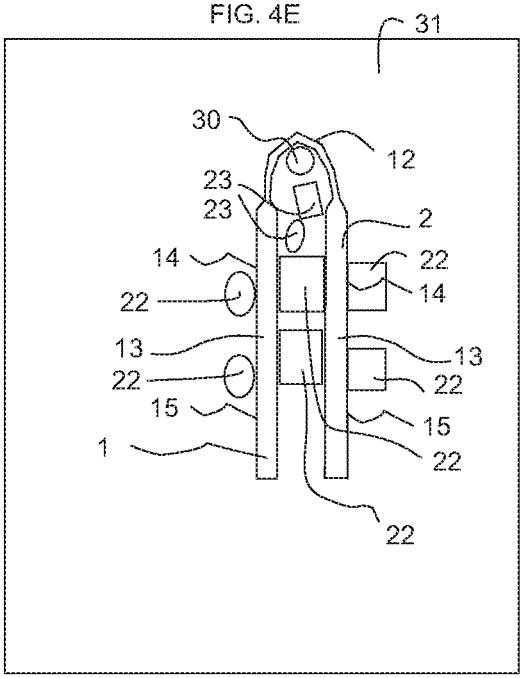
Figure 4E:
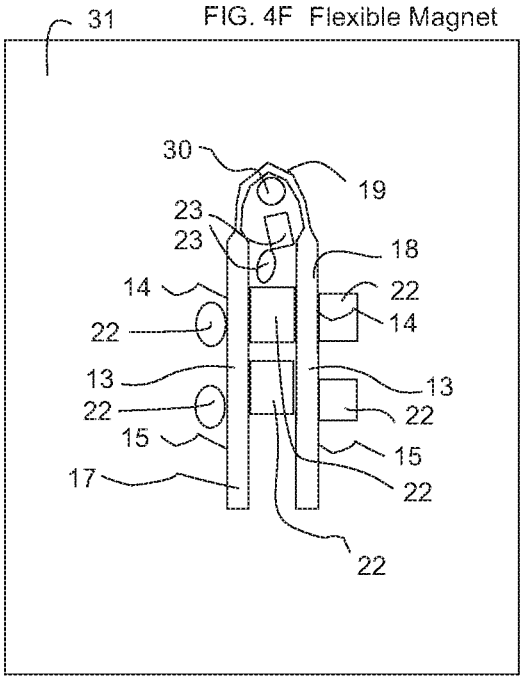
Figure 4G:
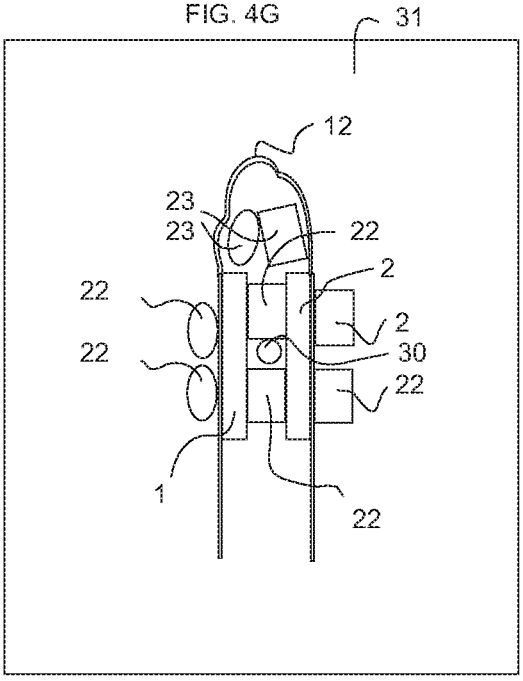
Figure 4H:
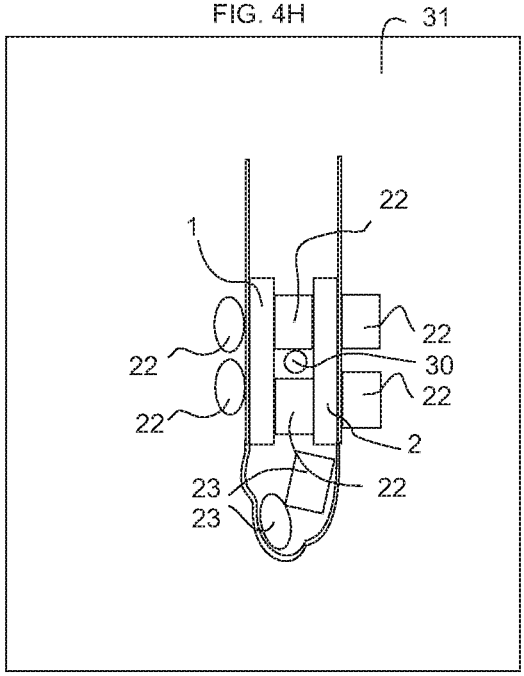
Figure 4J:
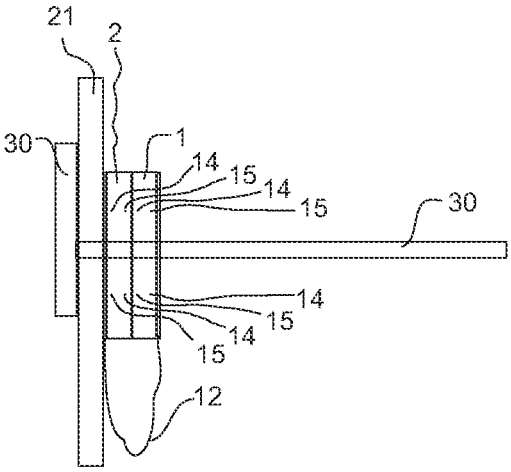
FIGS. 4J and 4K shows a side view of the preferred embodiment in one operational position on a peg board.
Figure 4K:
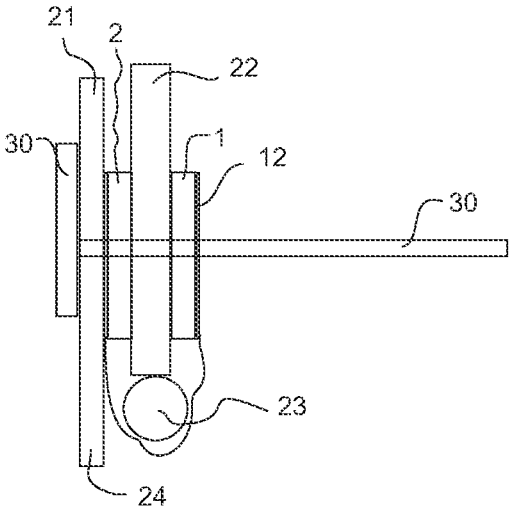
Figure 5A:
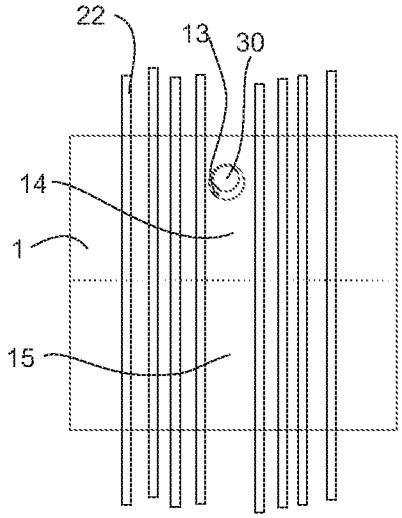
FIG. 5A shows a face view of the preferred embodiment in one operational position.
Figure 5B:
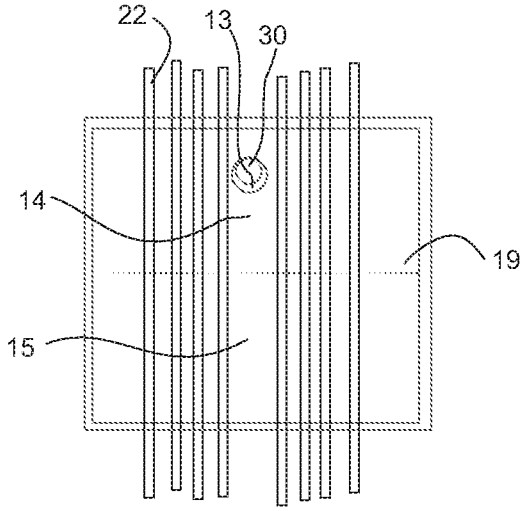
FIG. 5B shows a face view of an embodiment of flexible magnet in one operational position.
Figure 5C:
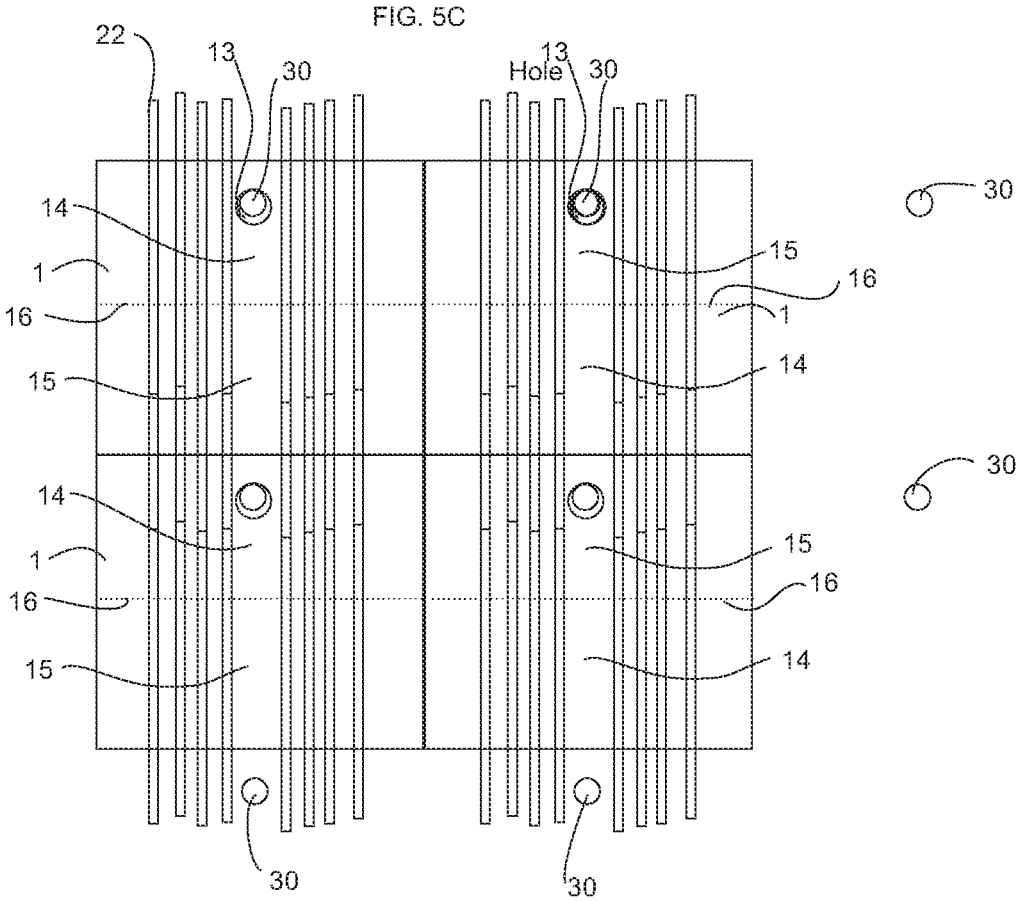
FIG. 5C shows a face view of the preferred embodiment in one operational position on a peg board.
Figure 6A:
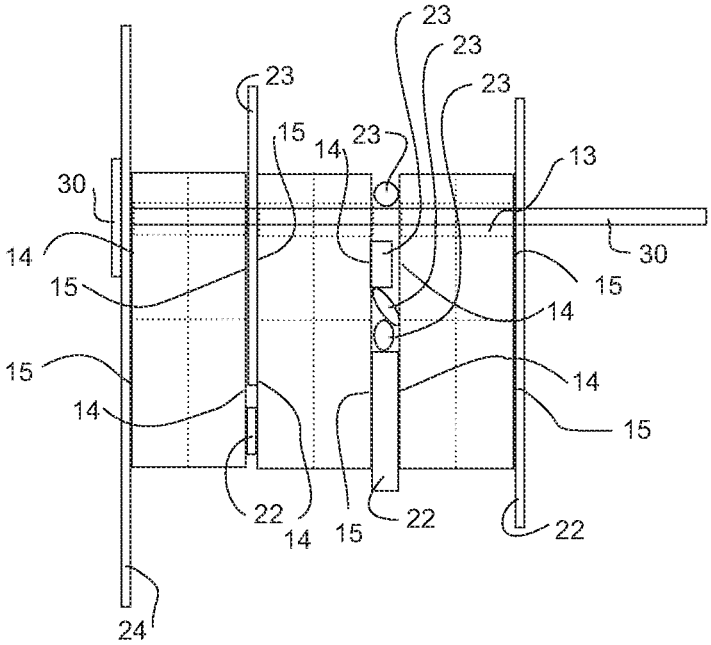
FIG. 6A shows a side view of the preferred embodiment in one operational position on a peg board.
Figure 6B:
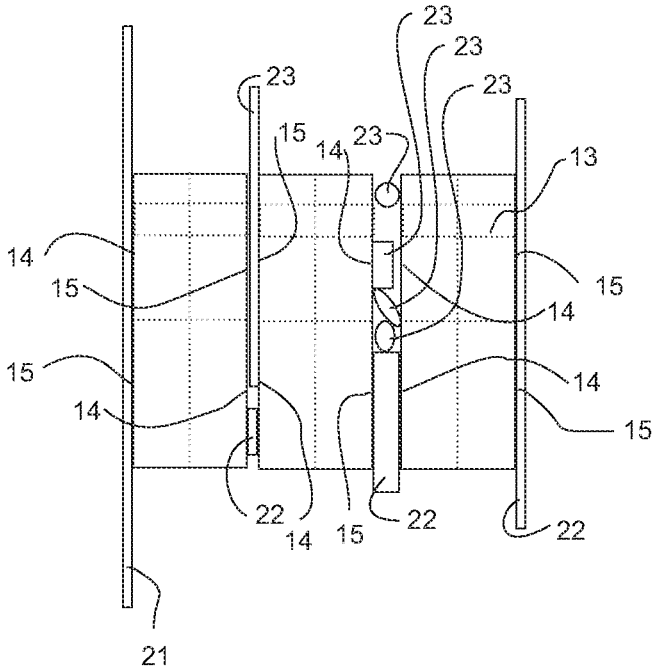
FIG. 6B shows a side view of the preferred embodiment in one operational position on a FMS.
Figure 7:
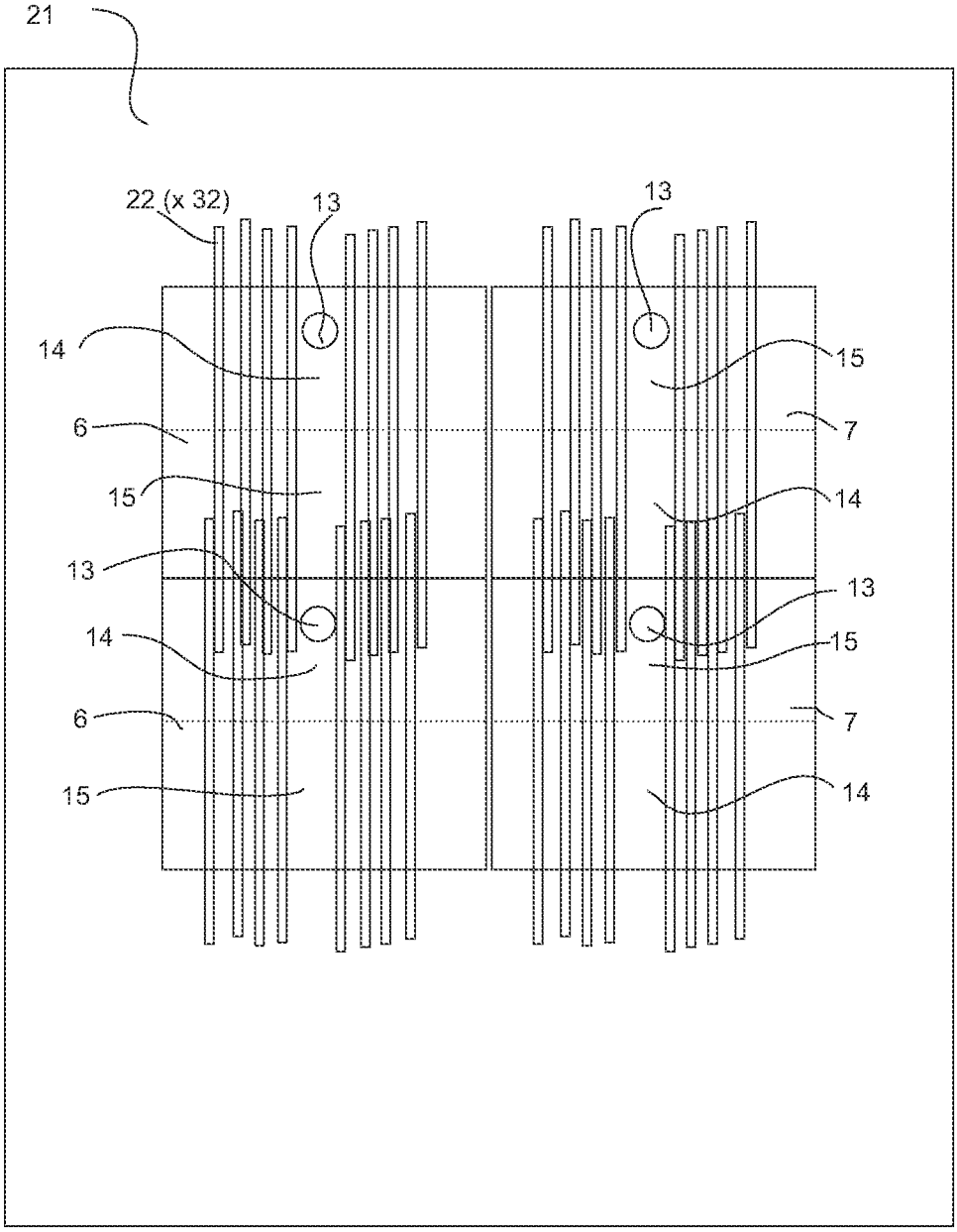
FIG. 7 shows a face view of the preferred embodiment in one operational position on a FMS.

FIG. 3A-3C shows an embodiment of a single magnet with at least two poles on each face 4 and a through hole 13. This magnet is the basic simplest module to build the permanent magnet system from. FIG. 3D-3F shows the basic magnet made of flexible magnet material with a lip. The lip provides a gap 11 and side to side connection by the flexible magnetic gap connector 10

Advantages

From the description above, a number of advantages of my permanent magnet system become apparent:

The use of at least two poles on each face will use less magnet material to obtain the same holding force on a thin flat solid FMS or thin flat solid FMP.

(a) Using a second magnet, the same as the first, to form an adjustable gap to obtain the optimum holding gap on FMS or FMP that are thick, curved or contoured (b) Using a two pole magnet's face to center itself on the zero line between North and South, to find magnetically the center of a FMP that is hidden from view.

(c) Using the system to pick, align parallel, and hold FMPs.

(d) to align at least one FMP magnetically parallel to alternating poles on the system face;

(e) Using the system to magnetically hold in parallel alignment at least two FMP;

(f) Using the system to transport FMPs from storage to work area, to open, deploy and display for work, use at work site as needed, to close up and transport back magnetically holding while also mechanically holding;

(g) to visually display FMP magnetically in rows, columns or a grid for easy to find parts;

(h) to label FMP locations by magnetically locating them in rows, columns and stacks therefore naming there locations by X, Y and Z coordinates;

(i) Using rectangular magnets with a least two poles on each face to hold magnetically on four sides to other magnets of the same to build an array of alternating polar alignment in X axis rows and Y axis columns;

(j) Using rectangular magnets with a least two poles on each face to hold magnetically face to face, in two pole polar alignment on the Z axis to form stacks;

(k) to hold two magnets magnetically wherein said first magnet is attracted to said second magnet by peripheries and the faces of each magnet are held magnetically to a FMS;

(l) to hold two magnets magnetically wherein said first magnet first face is attracted to said second magnet second face while also said second magnet first face is held magnetically to a FMS;

(m) to hold two magnets magnetically wherein said first magnet first face is attracted to said second magnet second face while also both magnets are held weakly magnetically on the sides to a FMS;

(n) to stack face to face with other magnets of the same two or more pole, polar alignment preventing rotation or slippage on the faces;

(o) to align face to face with other magnets of the of the same two or more pole, polar alignment automatically as the two magnets draw near to each other;

(p) to stack face to face with other magnets of the of the same two or more pole, polar alignment with FMPs in between magnets holding FMPs stronger magnetically as part of the magnetic circuit while also forming a mechanical cover;

(q) to pick up parts spilled on the counter or floor in alignment with poles in columns and rows on the magnets (r) to conduct the shortest possible magnetic circuit using the FMS and the FMP as complimentary return paths;

(s) to stack FMP and FMS on the first face increases the holding strength of FMPs and FMSs on the second face by creating the shortest possible complimentary magnetic circuit;

(t) to increase the magnet to magnet magnetic attraction when two such magnets are stacked face to face by placing FMPs and FMSs on the outside;

(u) to hold thin non-magnetic pieces between FMSs or other magnets of the same polar alignment;

(v) to hold FMPs with sharp points and edges in place, covered by flexible non magnetic gap connector(s) to hide the FMPs from damaging external things such as the user's body, user's pockets, back packs, carrying bags, while also protecting the FMPs from external things that may inflicting damage on the FMPs by impact while also protecting FMPs from damaging other FMPs in transit;

(w) to stack FMPs between two of these magnets face to face protects FMPs on both sides. Holds FMPs with sharp points and edges in place to protect user's body, user's pockets, FMPs from external impact damage, FMPs from damaging other parts while in storage;

(x) to join face to face mechanically with posts hooks through the through holes;

(y) to join side to side, mechanically with posts hooks through the through holes;

(aa) to join magnetically while also mechanically, face to face while also side to side to build on the X Y and Z axis directions While also increasing the alignment and holding strength of FMPs magnetically and mechanically by pinching. While also increasing the alignment and holding strength of each magnet to another magnet by the magnetic poles arranged to form aligned X Y and Z holding directions;

(bb) to assist some FMPs which already have a means of hanging partly or fully mechanically on a post hook, in this case the magnet can be used to even more securely hold, align and protect these type FMPs;

(cc) to facilitate transporting the magnetic system a bolt and nut or closing ring or cable or string may be disposed through the through hole of one or many magnets to facilitate alignment, securing the system, transportation from storage to work area, lowering and raising on a stick, mounting to other surfaces with fasteners and all the normal uses for holes to facilitate transportation;

(dd) to provide a means to hold in alignment non-magnetic pieces (NMP) mechanically affixed to the magnet via the magnet through hole; to allow non-magnetic parts to be held magnetically to FMS or other FMP or other magnet;

(ee) to provide a means to affix on a vertical wall or affix on a horizontal surface more than one magnet magnetically from a first magnet which is being held mechanically buy the first magnet hole and at least one second magnet is held magnetically to said first magnet face to face on the Z axis or side to side on the X or Y axis or any combination of the three axis;

(ff) to provide a magnetic system wherein magnets may be affixed mechanically by their through hole to a vertical, horizontal or up side down surface and at least one second magnet is held magnetically to said first magnet face to face on the Z axis or side to side on the X or Y axis or any combination of the three axis;

(gg) to provide a secondary means of holding the system mechanically to a post, wherein said first magnet is attracted and aligned to said second magnet face to face, with at least one ferromagnetic piece between the two magnets, forming a through hole, wherein said through hole is slid over a post;

(hh) to provide a permanent magnet system that is versatile to hold many thickness, curves and contours of FMP with the least amount of magnet material by multipolar magnets for holding on thin flat FMS and while also providing an adjustable gap between the multipolar magnets to accommodate thick, curved or contoured FMPs. After the FMPs to be applied is determined by the customer then the inventor must analyze the type material, dimensions, shape, curves and contours to determined the gap between multipolar magnets. If the gap is determined greater than zero then my system provides an adjustable gap from only a crack to the desired optimum. Once the gap is determined greater than zero my system provides a mechanical means to keep that gap. The preferred mechanical means is adhesive sheet or tape of the flexible, non-magnetic type (i.e. vinyl, leather, pleather, duct, PVC, PE, PU, cloth, etc.). Alternatively, sewing or ultrasonic welding or molding of a non-magnetic, flexible material can be used to set the gaps between magnets;

(ii) to provide a flexible non-magnetic gap connector material (FNGCM) that will facilitate folding the magnets face to face while also being rigid enough to keep the gap parallel to the magnet edges and of the size gap desired. The gap material will not stretch much, this prevents the gap from changing size;

(jj) to provide a system with flexible non-magnetic gap connector material to maintain alternating magnetic poles in (a) column(s) and (a) row(s) the gap is consistent down a column or across a row(s) to provide parallel alignment:

(kk) to provide excess flexible non-magnetic gap connector material (FNGCM) when needed which facilitates hanging by mechanical means other than a hole through the magnet by offering holes through in the connector material;

(ll) to provide adjustable flexible non-magnetic gap connector material (FNGCM) to increase the gap when needed for the capacity of holding and protecting FMPs and NMPs when folded closed face to face.

(mm) to provide system with a means of hanging mechanically wherein said first magnet hole is slid over one post hook while connector mechanically holds second magnet vertically below first magnet no second post hook is needed;

(nn) to provide system with a means of hanging mechanically wherein first connector material from first face to face holds the gap on the first face while a second connector material from second face to face holds the gap on the second face while the first connector material and second connector material in the gap are affixed to each other to hold the gap distance more strongly;

(oo) to provide system with a means of hanging mechanically wherein said first magnet is folded face to face closed over said second magnet forming a loop with said connector wherein said connector loop is slid over a post or hook (pp) to provide system with a means of hanging mechanically wherein magnets do not have through holes instead the two connector materials have an excess tab of material with through holes in alignment when magnets are closed face to face or open, wherein said connector holes are slid over at least one post.

(qq) To use one two pole rectangular magnet 1 with a hole align with other(s) of the same magnets 2 magnetically and mechanically on three axis (X, Y and Z) to build a system in three axis to hold more pieces of FMP and NMP on three axis, with an adjustable gap to accommodate more sizes of FMS, FMP and NMP.

Operation—FIGS. 2A, 2B, 2E, 2F, 2H, 2G, 4C-4H, 5A-5C, 6A, 6B, 7, 10A, 10B, 11A-11D, 12A-12C, 13, 14A, 14B, 15A, 15B, 17, 24B, 24C, 25A, 25B, 25C, First the application(s) must be determined. There are multiple concurrent applications of using my permanent magnet system (PMS). They are similar to single use magnetic products of current day use. Some of the functions are:

1) Attracting Ferromagnetic Piece (FMPs) together in an organized parallel fashion.
2) Picking up FMP in parallel alignment from a surface like a table or floor.
3) Finding the center of FMP hidden behind non-ferromagnetic surfaces aligned with the center of a multi pole magnet.
4) Deploying magnetically onto a FMS in row(s) (X axis) and or column(s) (Y axis)
5) Mounting temporarily mechanically to a non-magnetic surface in row(s) (X axis) and or column(s) (Y axis)
6) Magnetically attaching to other like magnets,
7) Combination of holding magnetically to same magnets while also holding mechanically to same magnets
8) Holding FMPs in an open fashion, organizing, displaying, in parallel alignment, in columns and rows for use
9) Holding in a closed fashion for storing, protecting parts and people, when not in use for transport to and from a work site.

One such manner of using my system is a combination of holding magnetically, while holding mechanically, while holding the preferred gap, while offering a working position and a storage position, wherein alternating magnetic poles are aligned on the X Y and Z axis:

1) Magnetically holding to a thin ferromagnetic surface (FMS) on a first magnet first face while magnetically holding a first magnet side to a second magnet side or if a gap is desired then mechanically holding a first magnet side near a second magnet side with a gap, by means of a flexible gap connector, while the second magnet first face is holding to a thin FMS, while the second magnet second face is holding Ferromagnetic Pieces (FMPs) while in the working position.
2) Magnetically holding to a thin ferromagnetic surface (FMS) on a first magnet first face while the first magnet second face and the second magnet first face sandwich the FMPS, while holding strongly and protecting, while the second magnet second face is available to hold more FMPs not protected, while in the storing position.
3) Magnetically holding FMPs on a first magnet, first face, while magnetically holding a first magnet side to a second magnet side or if a gap is desired then mechanically holding a first magnet side near a second magnet side with a gap by means of a flexible gap connector, while the first magnet second face is holding FMPs, while on the second magnet first face holding FMPs while on the second magnet second face holding FMPs, while in the working position.
4) Magnetically holding FMPs on a first magnet, first face, not to be protected, while holding strongly FMPs to be protected between a first magnet second face, and a second magnet first face, while the second magnet second face is holding FMPs not to be protected, while mechanically held with temporary fasteners, while in the storing position.
5) Mechanically holding a first magnet to a non magnetic surface using temporary fasteners, while a first magnet first face magnetically holds FMPs, while magnetically holding a first magnet side to a second magnet side or if a gap is desired then mechanically holding a first magnet side near a second magnet side with a gap, by means of a flexible gap connector, while the second magnet is mechanically holding to a non magnetic surface using temporary fasteners, while the second magnet first face is holding FMPs, while the second magnet second face is holding FMPs, while in the working position.
6) Mechanically holding a first magnet to a non magnetic surface using temporary fasteners, while a first magnet first face holds FMPs not to be protected, while the first magnet second face and the second magnet first face sandwich the FMPS, while holding strongly and protecting, while the second magnet is held to a non magnetic surface using temporary fasteners, while the second magnet second face is available to hold more FMPs not protected, while in the storing position.

Temporary fasteners include: post hooks, plywood with wood screws, bolts, hook and loop, temporary reusable adhesives, latches, etc.

FMSs include: machine cabinets, appliance cabinets, automobile bodies, file cabinets, steel walls, steel pegboards, steel boats, steel trays, steel tables, heavy equipment, etc.

FMPs include: machined ferrous parts in process, blades, needles, drill bits, sockets, nails, screws, fasteners, thick tools, contoured tools, curved tools, pipes, rebar, scrap steel, etc.

Second the configuration of the system magnets, gaps and mechanical means of holding should be optimized to use the least amount of magnet material. The magnets will always be the same type. They will be rectangular tile shaped, with at least two poles on each face. The gaps will be determined by the FMS type and the FMP type.

For FMS less than 0.025" thick the ideal gap of zero is provided by a magnet with at least two poles on each face. For FMS greater than 0.025" thick the gap should equal one half the thickness of the FMS. For FMS that is curved gaps should be more frequent and the magnets should be smaller to create more magnet surface contact to the FMS. For FMS that are contoured the gaps should be wherever there is not any FMS to contact and the magnets should be where there is FMS to contact.

For FMP(s) the gaps will follow the same rules. For FMP(s) less than 0.025" thick the gap of zero provided by a multipolar magnet is ideal. For FMP(s) greater than 0.025" thick the gap should equal one half thickness of the FMP(s). For FMP(s) that is curved gaps should be more frequent and the magnets should be smaller to create more magnet surface contact to the FMP(s). For FMP(s) that are contoured the gaps should be wherever there is not any FMP(s) to contact and the magnets should be where there is FMP(s) to contact.

The mechanical means of holding the system to a non magnetic surface or together using temporary fasteners, the location of the mechanical means of holding supplied by the non-magnetic surface, the first magnet side to second magnet side gap connections desired, size of the connector material.

If a pegboard system or post hook system is provided then the mechanical means would be holes spaced in multiples of 1". If the desired gaps are crack gaps then the mechanical means would be holes in each magnet. If the desired gaps are very large then the mechanical means would be holes in the gap material. If the gap material is larger than the magnets then the mechanical means would be holes in the flexible gap connector material. If the NMS supplied has hook and loop fasteners then the mechanical means would be hook and loop fasteners. If an array of magnets is desired to be affixed that will be the versatile module for expansion then the magnets can be sandwiched between two layers of flexible non magnetic gap connector material that is over sized and the mechanical means of holding will be holes in the material After the FMPs to be applied is/are determined then the manufacturer must analyze the type material, dimensions, shape, curves and contours to determine the gap between magnets. If the gap is determined greater than zero then a gap will be added. Once the gap is determined greater than zero it can be set by mechanical means. The preferred mechanical means is adhesive sheet or tape of the flexible, non-magnetic type (i.e. vinyl, leather, pleather, duct, PVC, PE, PU, cloth, etc.). Alternatively, sewing or ultrasonic welding or molding of a non-magnetic, flexible material can be used to set the gaps between magnets.

The flexible non-magnetic gap connector material (FNGCM) will facilitate folding the magnets on top of each other but it will not allow magnets to be joined on the periphery in direct contact with no gap. The column(s) and row(s) will still be kept in alignment by the material w in the absence of magnetic alignment. The flexible non-magnetic gap connector material (FNGCM) will facilitate holding and protecting FMPs when folded closed and when stacked face to face. Therefore, it should be a durable, flexible material, with very little spring back memory. The flexible non-magnetic gap connector material (FNGCM) will facilitate hanging by mechanical means other than a hole through the magnet by offer a hole through the connector material. Therefore is should be durable. The flexible non-magnetic gap connector material (FNGCM) increases the capacity for holding and protecting FMPs and NMPs when folded closed and when stacked face to face. Therefore the size of it can be larger than the gap required for magnetic optimization.

The position of the magnets and the mechanical means of holding are versatile and determined by the FMS and FMP and NMP being held. At least the following configurations are offered:

1. Means of hanging mechanically wherein said first magnet hole is slid over a post or hook, connector mechanically holds second magnet vertically below first magnet
2. Means of hanging mechanically wherein first magnet is slid over a post and connector hold first magnet to second magnet, second magnet hole is slid over a second post in row or column alignment to said first magnet.
3. Means of hanging mechanically wherein said first magnet is folded closed over said second magnet forming a loop with said connector wherein said connector loop is slid over a post or hook
4. Means of hanging mechanically wherein a first magnet is connected with a connector to at least one second magnet wherein said connector hole is slid over a post.

CONCLUSION, RAMIFICATIONS AND SCOPE

Accordingly, the reader will see that the permanent magnet system of this invention is versatile to be used for multiple purposes concurrently and in multiple configurations concurrently. Although the descriptions above contain many specifications, these should not be construed as limiting the scope of the invention but as merely providing illustrations of the presently preferred embodiments of this invention. For example the system can be made of one flexible magnet forming all the portions. Thus the scope of this inventions should be determined by the appended claims and their legal equivalents, rather than by the example given.

I claim:

1. In a permanent magnet system comprising at least two permanent magnets, each system comprising:

a. a first magnet comprising a first face, a second face and a rectangular periphery around each said face,
b. each face comprising at least two magnetic poles, each pole being rectangular and alternating North and South,
c. each periphery comprising a first side, a second side, a third side and a fourth side
d. said poles of said first face being geometrically and magnetically opposite said two poles of said second face,
e. said poles of said first face and said poles of said second face being in alignment parallel to each other,
f. said poles of said first face and poles of said second face each being of sufficient magnetic strength to hold at least two elongated ferromagnetic pieces in parallel alignment with said alternating poles,
g. said poles of said first face and said second face each being of sufficient magnetic strength to hold said magnet to a ferromagnetic holding surface while holding said ferromagnetic pieces magnetically on said second face of said magnet,
h. said alternating poles of said magnet having no gap,
i. at least one second magnet, the same as the first,
j. said poles of said first magnet and said poles of said second magnet each being of sufficient magnetic strength and polar alignment to align and hold said first magnet at each of the four sides with a second magnet side to grow the system on the X axis and the Y axis,
k. said poles of said first face and said poles of second face being of sufficient magnetic strength and polar alignment to stack said first magnet face to face with at least one second magnet to grow the system on the Z axis,
l. said poles of said first magnet and said second magnet each being of sufficient magnetic strength to stack said magnet face to face with at least one second magnet while also being of sufficient magnetic strength to hold between said faces at least one ferromagnetic piece and or at least one non magnetic piece,
m. said system having at least one means of holding and releasing mechanically,
n. said system having at least one means of holding and releasing magnetically.

2. In a permanent magnet system comprising at least two permanent magnets, each system comprising:

a. at least one flexible connector of said first magnet to said second magnet, with said poles in alignment on the X axis and Y axis,
b. said flexible connector forming a gap between said first magnet side and said second magnet side,
c. a first magnet comprising a first face, a second face and a rectangular periphery around each said face, each face comprising at least two magnetic poles, each pole being rectangular and alternating, each periphery comprising a first side, a second side, a third side and a fourth side d. said poles of said first face being geometrically and magnetically opposite said two poles of said second face, e. said poles of said first face and said poles of said second face being in alignment parallel to each other, f. said poles of said first face and poles of said second face each being of sufficient magnetic strength to hold at least two elongated ferromagnetic pieces in parallel alignment with said alternating poles, g. said poles of said first face and said second face each being of sufficient magnetic strength to hold said magnet to a ferromagnetic holding surface while holding said ferromagnetic pieces magnetically on said second face of said magnet, h. said alternating poles of said magnet having no gap, i. at least one second magnet, the same as the first, j. said poles of said first magnet and said poles of said second magnet each being of sufficient magnetic strength and polar alignment to align and hold said first magnet at each of the four sides with a second magnet side to grow the system on the X axis and the Y axis, k. said poles of said first face and said poles of second face being of sufficient magnetic strength and polar alignment to stack said first magnet face to face with at least one second magnet to grow the system on the Z axis, l. said poles of said first magnet and said second magnet each being of sufficient magnetic strength to stack said magnet face to face with at least one second magnet while also being of sufficient magnetic strength to hold between said faces at least one ferromagnetic piece and or at least one non magnetic piece, m. said system having at least one means of holding and releasing mechanically, n. said system having at least one means of holding and releasing magnetically.

3. The system of claim 2 further comprising:

a. said connector forming a hinge is affixed to said first magnet and said second magnet to open and close said first magnet and said second magnet magnetically attracting on at least one ferromagnetic part while forming a pouch to hold non magnetic parts.

4. The system of claim 2 further comprising:

a. one said first magnet portion with at least two poles on each face, at least one said second magnet portion with at least two poles on each face and said flexible connector being a continuous piece of flexible magnet material, i. said means of hanging mechanically comprising a hole through said first magnet portion of said continuous piece and a hole through said second magnet portion of said continuous piece, wherein said hole through said first magnet portion aligns with said hole through said second magnet portion while the poles are magnetically aligned.

5. The system of claim 2 further comprising:

a. a first said connector material is affixed to said first magnet first face and affixed to said second magnet second face while said connector material also extends excess material beyond the first magnet side opposite said gap, while also said flexible connector material extends excess material beyond the second magnet side opposite said gap, wherein said first hole is disposed through said excess material of said first magnet and said second hole is disposed through said excess material of said second magnet.

6. The system of claim 5 further comprising:

a. a second said connector the same as the first said connector is affixed to said first magnet second face and affixed to said second magnet first face.

7. The system of claim 5 wherein magnet further comprises:

a. At least one magnet hanging magnetically from a ferromagnetic surface while also hanging mechanically from a post through said holes, wherein ferromagnetic pieces are magnetically held to said first magnet second side and between said second magnet second face, wherein ferromagnetic pieces are also held to said second magnet first face, wherein non magnetic pieces are held in said flexible connector.

8. The system of claim 1 further comprising:

a. Said first magnet, wherein the magnet length and width are a multiple of the distance between centers of two holes on a pegboard system, b. wherein said at least one second magnet is same size as said first magnet, c. wherein said means of hanging mechanically is a through hole of sufficient size to slide over a pegboard post hook located in the geometric center of said magnet i. said first means of hanging mechanically wherein said first magnet hole is slid over a post or hook, said second magnet hole is slid over a second nearby post or hook, ii. said second means of hanging mechanically wherein said first magnet hole and said second magnet hole are slid over the same post or hook, iii. said third means of hanging mechanically wherein said first magnet and said second magnet are attracting onto at least one ferromagnetic piece forming a gap between said magnets wherein said gap is slid over a post or hook d. said means of hanging magnetically i. said first means of holding magnetically wherein all magnets join side to side, with faces having alternating poles in rows and or columns whereby the system holds to a ferromagnetic surface that is curved or flat, ii. said second means of hanging magnetically wherein said first magnet and said second magnet are stacked face to face attracting with poles aligned, holding to a ferromagnetic surface that is curved or flat, FMPs may be held on the face opposite the FMS, iii. said third means of hanging magnetically is using said side having alternating magnetic poles to hold magnetically to a ferromagnetic surface that is curved or flat, iv. said fourth means of hanging magnetically as in said second means of hanging magnetically except ferromagnetic pieces and non magnetic pieces are held between at least one said magnet face and said ferromagnetic surface v. said fifth means of hanging magnetically as in said second means of hanging magnetically except ferromagnetic pieces and non magnetic pieces are held between said magnet faces e. wherein said first magnet connects magnetically on at least one periphery alternating poles to said at least one second magnet periphery alternating poles forming a common face, wherein said poles of said common face forms alternating poles of at least one rectangular shape and align prepared to build a modular system of rectangular alternating pole alignment or grid.

9. The system of claim 2 further comprising:
a. said first magnet is four poles on each face
b. said second magnet is four poles on each face.

10. The system of claim 2 further comprising:
a. said magnets in open position wherein ferromagnetic pieces hold magnetically across the gap and serve to hold non magnetic pieces in the gap.

11. The system of claim 2 further comprising:
a. said magnets in open position attracting said ferromagnetic surface, said connector serves to hold non magnetic pieces between said connector and said ferromagnetic surface.

12. The system of claim 2 further comprising:
a. said system affixed with temporary fasteners to a surface with the gaps optimized to hold steel parts in alignment to said alternating poles on the sides of said magnets to be welded or glued at preset angles.

13. The system of claim 2 further comprising:
a. wherein said magnets are not of sufficient strength to hold magnetically therefore said ferromagnetic piece is held partially magnetically pinched in between magnets while also held mechanically by said flexible connector.

14. The system of claim 2 further comprising:
a. said system stacked magnetically on a second said system magnets magnetically attracting, with said ferromagnetic pieces held magnetically in between, while being mechanically held by said holes onto said post or bolts with nuts or cable ties or closable C ring or screw driver or stick or by any temporary mechanical means.

15. The system of claim 2 further comprising:
a. said magnets stacked face to face, attracting magnetically through ferromagnetic pieces, aligned, while held mechanically by at least one post through at least one hole, while holding magnetically to a ferromagnetic surface.

16. The system of claim 2 further comprising:
a. said magnets with both faces curved to match the curve of said ferromagnetic surface, said magnets poles aligned attracting magnetically, side to side, forming a first common face and a second common face, said first common face magnetically attracting a curved ferromagnetic surface in an array forming grid of alternating poles, said second common face holding magnetically, said ferromagnetic pieces, in alignment perpendicular and parallel on said grid.

17. The system of claim 2 further comprising:
a. at least four magnets with at least two poles on each face
b. said many magnets are arranged side to side in rows X axis and columns Y axis forming said poles in a rows X axis and columns Y axis,
c. said gap sizes between said magnets side to side are determined to hold the size and shape of at least one ferromagnetic piece to be held,
d. a first said connector is affixed to the first face of all the magnets,
e. a second said connector is affixed to the second face of all the magnets,
f. said means of hanging mechanically comprising at least two holes through said flexible connector material,
g. several systems may be stacked magnetically on the Z axis held magnetically and held by temporary mechanical fastener(s).

18. The system of claim 17 further comprising:
a. Magnets being arranged with a gap on the middle line of symmetry to allow each said connector to hinge closed wherein half of the magnets close onto the other half face to face in polar alignment,
b. at least one FMP is held between said faces,
c. when closed the connector forms a pouch to hold non magnetic parts,
d. said holes through said connector align with each other when system is folded closed,
e. when said system is closed several systems may be stacked magnetically on the Z axis in attracting alignment and held by a temporary mechanical fastener(s).

19. The system of claim 18 wherein said the rows X axis and columns Y axis are labeled.

20. The system of claim 1 wherein said magnet has at least one hanging tab with a hole, affixed.

21. The system of claim 1 wherein said first magnet has a string or a stick affixed to said hole and is used for finding FMPs like rebar, nails, screws, steel pipe which is not visible to the eye, wherein magnet magnets are aligned for easy marking of location on center between said at least two alternating poles.

22. The system of claim 1 wherein said first magnet has a string or a stick affixed to said hole and is used for picking up spills of FMPs like rebar, nails, screws, steel pipe which are in difficult to reach places by hand, wherein FMPs are aligned for easy removal and organization by centering and aligning FMPs magnetically between said at least two alternating poles.

* * * * *